US012025120B2

(12) United States Patent
Elberson

(10) Patent No.: US 12,025,120 B2
(45) Date of Patent: Jul. 2, 2024

(54) DUAL BIAS REGULATOR ASSEMBLY FOR OPERATING DIAPHRAGM PUMP SYSTEMS

(71) Applicant: Autoquip, Inc., Menomonee Falls, WI (US)

(72) Inventor: Michael D. Elberson, Brookfield, WI (US)

(73) Assignee: Autoquip, Inc., Menomonee Falls, WI (US)

( * ) Notice: Subject to any disclaimer, the term of this patent is extended or adjusted under 35 U.S.C. 154(b) by 372 days.

(21) Appl. No.: 17/405,205

(22) Filed: Aug. 18, 2021

(65) Prior Publication Data

US 2022/0042507 A1 Feb. 10, 2022

Related U.S. Application Data

(63) Continuation-in-part of application No. 16/433,103, filed on Jun. 6, 2019, now Pat. No. 11,466,676.

(60) Provisional application No. 62/699,258, filed on Jul. 17, 2018.

(51) Int. Cl.

| | |
|---|---|
| ***F04B 53/10*** | (2006.01) |
| ***F04B 43/02*** | (2006.01) |
| ***F04B 43/073*** | (2006.01) |

(52) U.S. Cl.

CPC ..... *F04B 53/10* (2013.01); *F04B 43/02* (2013.01); *F04B 43/073* (2013.01); *F04B 43/0736* (2013.01)

(58) Field of Classification Search

CPC ..... F04B 53/10; F04B 43/02; F04B 43/0736; F04B 43/073

See application file for complete search history.

(56) References Cited

U.S. PATENT DOCUMENTS

| | | | | |
|---|---|---|---|---|
| 2,308,974 | A | 1/1943 | Harper | |
| 3,741,689 | A * | 6/1973 | Rupp | F04B 9/135 417/393 |
| 4,551,072 | A | 11/1985 | Barall | |
| 4,728,267 | A | 3/1988 | Ruttenberg et al. | |
| 5,062,770 | A | 11/1991 | Story et al. | |
| 7,665,974 | B2 | 2/2010 | Hembree | |
| 8,425,208 | B2 * | 4/2013 | McCourt | F04B 9/133 417/395 |
| 8,485,792 | B2 | 7/2013 | McCourt et al. | |
| 8,608,460 | B2 | 12/2013 | McCourt et al. | |
| 8,632,315 | B2 | 1/2014 | Headley | |
| 8,632,316 | B2 | 1/2014 | Headley | |

(Continued)

*Primary Examiner* — Nathan C Zollinger

(74) *Attorney, Agent, or Firm* — Boyle Fredrickson, S.C.

(57) ABSTRACT

A diaphragm pump mechanically operable air pressure regulator assembly that is operable in direct response to the relative operation of an associated diaphragm pump system. The regulator assembly includes a housing that is constructed to receive a static air pressure signal. A cam arrangement is disposed in the regulator housing and is constructed to mechanically cooperate with a shaft of a respective diaphragm pump system. Axial translation of the shaft of the diaphragm pump system effectuates rotation of the regulator cam arrangement. The relative motion of the cam arrangement with respect to the regulator housing manipulates a force associated with a biasing device disposed in the regulator and thereby the relative degree of the static air pressure signal that is communicated to the respective diaphragm pump system.

19 Claims, 12 Drawing Sheets

(56) References Cited

U.S. PATENT DOCUMENTS

| | | | | |
|---|---|---|---|---|
| 8,632,317 | B2 | 1/2014 | Headley | |
| 8,801,404 | B2 | 8/2014 | McCourt et al. | |
| 9,316,218 | B2 | 4/2016 | McCourt et al. | |
| 9,777,721 | B2 | 10/2017 | Hines et al. | |
| 9,777,722 | B2 | 10/2017 | Hines et al. | |
| 9,784,265 | B2 | 10/2017 | Hines et al. | |
| 10,072,650 | B2 | 9/2018 | Hines et al. | |
| 10,161,393 | B2 | 12/2018 | Hines et al. | |
| 11,448,204 | B2 * | 9/2022 | Yamada | F16K 11/07 |
| 2013/0272901 | A1 | 10/2013 | McCourt et al. | |
| 2013/0287608 | A1 * | 10/2013 | Elliott | F04B 49/22<br>417/435 |
| 2014/0037465 | A1 | 2/2014 | McCourt et al. | |
| 2014/0348667 | A1 | 11/2014 | McCourt et al. | |
| 2019/0093651 | A1 | 3/2019 | Hines et al. | |
| 2023/0332590 | A1 * | 10/2023 | Morris | F04B 53/001 |

* cited by examiner

DUAL BIAS REGULATOR ASSEMBLY FOR OPERATING DIAPHRAGM PUMP SYSTEMS

CROSS-REFERENCE TO RELATED APPLICATIONS

This application claims priority to currently pending U.S. Non-Provisional patent application Ser. No. 16/433,103 filed on Jun. 6, 2019 titled "Control Arrangement And Method For Operating Diaphragm Pump Systems" and which claims priority to U.S. Provisional Patent Application Ser. No. 62/699,258 filed on Jul. 17, 2018, the disclosures of each of which are incorporated herein by reference.

FIELD OF THE INVENTION

The present invention relates to the construction and operation of a regulator assembly for controlling operation of diaphragm pumps, and in particular, to a mechanical dual bias regulator assembly and method of controlling diaphragm pump operation in a cost effective manner to mitigate respective side specific pressure deviations experienced during the cyclic operation of diaphragm pump systems that include independently operable diaphragms and which is constructed to better withstand conditions associated with the operating environment.

BACKGROUND OF THE INVENTION

Diaphragm pumps are commonly understood as positive displacement pumps that offer smooth flow, reliable operation, and the ability to pump a wide variety of viscous, chemically aggressive, abrasive and impure liquids. Some such pumps commonly include a pair of pumping diaphragms that are each associated with a respective pump or pumping diaphragm chamber. Each of the respective pumping diaphragms are commonly operatively associated with a shaft which oscillates in opposite axial directions during the intake and exhaust strokes associated with movement of the discrete diaphragms. Such pumps are used in many industries such as mining, chemical, petro-chemical, pulp, paper, and other industries. Such paired pumping diaphragm pump assemblies are susceptible to some shortcomings.

During operation of such pumps, an air valve directs pressurized gas, such as air, in a generally alternating sequential manner to each of the respective diaphragm chambers of a pair of diaphragm chambers. The gas flow pushes a respective fluid moving diaphragm across a respective chamber and a fluid on an opposite side of the diaphragm is forced out of the fluid side of the discrete diaphragm chamber. During the discharge stroke associated with one diaphragm chamber, the diaphragm associated with the opposite chamber is pulled towards the center of the pump assembly or in a common direction relative to translation of the first diaphragm, by the shaft or connecting rod, thereby effectuating an intake stroke associated with one diaphragm chamber during the discharge stroke associated with the opposing discharge chamber. That is, the cyclic operation of the shaft, and the working fluid diaphragms associated therewith, creates a liquid suction pressure in one diaphragm chamber during the pressure or discharge stroke associated with operation of the opposite diaphragm.

When provided in a dual diaphragm pump assembly, when a retracting diaphragm or respective diaphragm plate associated with one diaphragm approaches a center portion of the pump assembly, it interacts with a pilot valve rod which diverts a pulse of air that is directed to the air valve thereby diverting the working gas flow toward an alternate passage associated with the valve assembly so as to direct the connecting rod, and the respective diaphragm associated therewith, in a respective opposite axial direction. Movement of the pilot valve rod also commonly effectuates fluid connectivity associated with the gas side of the pumping diaphragm associated with the recently discharged pump chamber to allow the gas charge associated with each fluid discharge stroke to be directed toward an outlet or an exhaust.

The pneumatic operation of such pumps allows utilization of the same in instances where electrically driven pumps are not preferred. Such pumps are commonly self-priming, can withstand periods of being operated with a fluid flow, and can be constructed of components that can withstand hazardous liquids, liquids of various and/or changing viscosities, and can manage to pump fluids contaminated with solid matter. Accordingly, such pumps have various attributes that render them more desirable for use under operating conditions unsuitable for other pump devices.

As alluded to above, during operation of the dual diaphragm pump assemblies, air is ported through the air valve piston of the respective diaphragm pump into a center block or air manifold assembly where two directional ports direct the air to the respective left-hand or right-hand sides of the diaphragm pump assembly. Such pumps have two liquid chambers, two air chambers, and two diaphragms. In each pair of chambers, the liquid or working fluid chambers and air chambers are separated or fluidly isolated from one another by the respective flexible diaphragms.

With respect the operating gas or air chamber side of the discrete diaphragm chambers, the air pressure is applied on the back side of one diaphragm forcing the product or working fluid out of the liquid chamber associated with the respective side of the pump assembly and into a fluid discharge manifold connected to the pump assembly. As the two diaphragms are connected by the rod, connecting rod, or shaft, the diaphragm opposite the current discharge stroke side of the pump assembly is pulled towards the center of the pump assembly as the opposite pump chamber undergoes a discharge stroke. Said in another way, the axial displacement associated with each discharge stroke causes an intake or a suction stroke on the other diaphragm pump chamber. Ball valves associated with the fluid intake passage and the fluid discharge passage of each discrete pump chamber alternately open and close the respective intake and discharge passages associated with the respective diaphragm chambers to fill the respective pump chambers and to prevent back flow of the working fluid into the discrete working fluid diaphragm chamber during the cyclic operation of the pump assembly.

At the end of the shaft stroke in each of the opposite axial directions, the air mechanism (air valve retracting diaphragm) automatically shifts the operational direction associated with the positive air pressure signal to the opposite side of the pump assembly thereby reversing the direction of the axial translation associated with the cyclic action of the pump.

Even though such pumps are robust, such dual pumping diaphragm pump assemblies are not without their drawbacks. Stalling of the operation of such dual pumping diaphragm pumps can be caused by insufficient pressure differentials between the fluid working side and the air chamber side of the respective pumping diaphragm chambers and/or unbalanced pressure differentials between the respective discrete intake and exhaust side fluid and air flow passages associated with the discrete, but operationally connected, pumping diaphragm chambers. Such assemblies can also be rendered inoperable or stall due to failure of one or more of the seals associated with the connecting rod or shaft associated with the air flow side of the discrete pumping diaphragm chambers. Failure of one of more of the connecting rod seals commonly results in insufficient air flow pressure signals being communicated to the respective air flow side of the respective diaphragm chambers thereby resulting in stalling of the cyclic operation of the underlying diaphragm pump assembly.

Many dual diaphragm reciprocating fluid pumps also produce what appears as a pressure surge or spike associated with the working fluid flow that is created during the reversal or changeover associated with the operating direction or the alternative axial translation of the control rod or connecting shaft and/or the respective diaphragms associated therewith. However, closer inspection has determined that the pressure spike is actually a pressure drop followed by a small pressure spike associated with the discharge of the working fluid flow.

Each time the pump reverses the axial operation direction, the operational air pressure is removed from the near empty or recently discharged working fluid chamber side of the pump assembly and is applied to the recently fluid filled pump chamber. As the pump operating air changes pump chambers, both pumping diaphragms, and the connecting rod associated therewith, change operational direction and the fluid output pressure reduces until the operating air adequately fills the alternate air chamber thereby increasing the fluid side pressure from a suction stroke pressure to an operating pressure and ultimately a pressure associated with effectuating a working fluid discharge stroke.

Devices downstream of the pump assembly can be sensitive to such pressure changes and some applications depend on more stable or steady state fluid flows to achieve a desired process. Recognizing the shortcomings associated with utilization of such pump assemblies, current methodologies rely upon supplemental devices, such as fluid flow surge suppressors or the like that are located upstream or downstream of dual pumping diaphragm pump assemblies to mitigate the undesirable pressure changes and to stabilize the fluid flow signal. Unfortunately, the pressure deviations associated with the working fluid flow can also be detrimental to the intended operation of such devices.

Such pressure vessels commonly include a housing that defines a pressure chamber and a surge chamber that are fluidly separated from one another by a fluid separating diaphragm. The pressure vessels provide a temporary pressure accommodation, such as a temporary pressure storage when the pump output pressure surges or the pump pressure spikes. Utilization of such methodologies increase the cost associated with the manufacture and installation of systems having such a pressure signal arresting device. Additionally, if the fluid material contains effluent or suspended particulate matter, such approaches are also more susceptible to plugging, increase system flushing difficulty, can result in assembly fracture if the pumped pressure exceeds rated values, detracts from maintenance efficiency due to wear and corrosion, and can lead to undesired operation of the underlying system due to reductions in the effectiveness of the system if the gas flow pressure is incorrect or lost.

Still further, controlling operation of the discrete diaphragm pump assemblies, and the shuttle valves associated therewith, with conventional air pressure regulators can fail to adequately consider and address changes to the pumped fluid pressure signals near the terminal ends of the discharge strokes associated with the discrete diaphragm assemblies. That is, conventional air pressure regulators are constructed to provide a desired operating pressure to the discrete diaphragm pump shuttle valve assemblies throughout the range of motion of the discrete diaphragm assemblies. Increases in the working fluid pressure signals as the discrete diaphragms approach their respective end of stroke positions can result in working fluid pressure flow signals that detrimentally affect the cyclic operation of the discrete diaphragms when the working fluid flow pressure approaches the operating pressure provided by the discrete air pressure regulators. Simply increasing the operating pressure associated with the air pressure regulators detrimentally affects operation of the discrete diaphragm pump assemblies at locations that are offset from the respective end of discharge stroke performance from desired values and the cyclic nature associated with operation of the discrete diaphragm pumps renders end of discharge stroke manual adjustment of the air pressure signal communicated to the discrete diaphragms unfeasible and impractical. Accordingly, there is a need for a diaphragm pump regulator system and method for manually adjusting the pressure provided by the air regulator that is adjustable on a per stroke basis and mechanically adjustable as a function of a relative stroke location of the discrete working fluid diaphragms.

SUMMARY OF THE INVENTION

The present application discloses a diaphragm pump system and control arrangement that solves one or more of the shortcomings disclosed above. One aspect of the application discloses a diaphragm pump system that includes a pair of working fluid diaphragm pump assemblies that are each fluidly connected to a working fluid flow. Each working fluid diaphragm pump assembly is operationally associated with a discrete drive arrangement that is fluidly isolated from the working fluid flow that is moved during operation of the pump system. A control arrangement is connected to the discrete drive arrangements and configured to control the cyclic operation of the pair of working fluid diaphragm pump assemblies to mitigate pulsatile effects in the combined working fluid flow when the discharges of the working fluid flows associated with operation of the pair of working fluid diaphragm pump assemblies is combined.

Another aspect of the present application that is combinable or useable with one or more of the above aspects discloses a diaphragm pump system that includes a first pump assembly and a second pump assembly. Each pump assembly includes a housing, a working fluid pumping diaphragm that is disposed in the housing, and a shaft that is supported by the housing and attached to the working fluid pumping diaphragm such that the working fluid pumping diaphragm of each of the first pump assembly and the second pump assembly are independently operable relative to one another. An inlet manifold is fluidly connected to an inlet side of each of the first pump assembly and the second pump assembly. A discharge manifold is fluidly connected to a discharge side of each of the first pump assembly and the second pump assembly. A first diaphragm retracting assembly is connected to the first pump assembly and configured to manipulate operation of the shaft of the first pump assembly. A second diaphragm retracting assembly is connected to the second pump assembly and configured to manipulate operation of the shaft of the second pump assembly independent of the first diaphragm retracting assembly. A control arrangement is connected to the first diaphragm retracting assembly and the second diaphragm retracting assembly and is configured to oscillate operation of the working fluid pumping diaphragm of the first pump assembly and the second pump assembly to create a generally uniform discharge pressure associated with an outlet of the discharge manifold. Preferably, each of the retraction operation and the discharge operation associated with operation of the discrete pump assemblies is independently controllable such that an intake stroke associated with one working fluid pumping assembly does not adversely affect the working fluid flows associated with the second working fluid pump assembly.

A further aspect of the present application that is useable or combinable with one or more of the above aspects discloses a method of forming a diaphragm pump assembly. The method includes connecting a first working fluid pumping diaphragm pump assembly to a first diaphragm retracting assembly and connecting a second working fluid pumping diaphragm pump assembly to a second diaphragm retracting assembly that is independently operable relative to the first working fluid pumping diaphragm pump assembly. The first working fluid pumping diaphragm pump assembly and the second working fluid pumping diaphragm pump assembly are connected to a respective working fluid intake and a respective working fluid discharge. Operation of the first diaphragm retracting assembly and the second diaphragm retracting assembly is controlled to effectuate operation of the first working fluid pumping diaphragm pump assembly and the second working fluid pumping diaphragm pump assembly to balance a flow value and a pressure value associated with a combined output of the working fluid discharges.

Another aspect of the present application that is usable or combinable with one or more of the above features or aspects discloses a diaphragm pump system that includes a first working fluid diaphragm pump assembly and a second working fluid diaphragm pump assembly. Each of the first working fluid diaphragm pump assembly and the second diaphragm pump assembly include a respective diaphragm that is disposed in a respective working fluid diaphragm pump chamber. A first drive arrangement that is fluidly isolated from a working fluid flow is connected to the diaphragm of the first working fluid diaphragm pump assembly such that the first drive arrangement is operable to effectuate cyclic operation of the diaphragm of the first working fluid diaphragm pump assembly relative to the working fluid diaphragm pump chamber of the first working fluid diaphragm pump assembly. A second drive arrangement is also fluidly isolated from the working fluid flow and is connected to the diaphragm of the second working fluid diaphragm pump assembly. The second drive arrangement is operable to effectuate cyclic operation of the diaphragm of the second working fluid diaphragm pump assembly relative to the working fluid diaphragm pump chamber of the second working fluid diaphragm pump assembly. A control arrangement is connected to each of the first drive arrangement and the second drive arrangement and configured to control operation of the first working fluid diaphragm pump assembly and the second working fluid diaphragm pump assembly to create a steady state condition of a pressure and a flow of the working fluid discharged from the first working fluid diaphragm pump assembly and the second working fluid diaphragm pump assembly.

Another aspect of the present invention that is useable or combinable with one or more of the above aspects discloses a ball valve assembly that is associated with the working fluid flow associated with one or more of the working fluid diaphragm pump assemblies as disclosed above. The ball valve assembly includes a seat that is defined by a portion of the housing associated with working fluid diaphragm pump assembly. A seal is supported by the seat and oriented to engage the ball to selectively close the passage associated with the ball valve assembly when the ball is engaged therewith. In a preferred aspect, the ball includes a weight that is oriented to gravitationally bias the ball into engagement with the seal associated with the seat when desired.

A further aspect of the present invention discloses a diaphragm pump regulator assembly that includes a housing having an inlet configured to be connected to an air source and an outlet configured to be connected to a diaphragm pump. A diaphragm or valve is disposed in the housing between the inlet and the outlet and a biasing device is disposed in the housing between the valve and the outlet. The biasing device is configured to manipulate a position of the valve relative to the housing. A first cam and a second cam are disposed in the housing and configured to manipulate a force associated with biasing device. A shaft is secured to the first cam and rotatable relative to the housing and a driven element is secured to the shaft and operable to rotate the shaft and the first cam to manipulate the force associated with the biasing device in response to axial translation of a shaft associated with a diaphragm pump.

Another aspect of the present invention discloses a mechanically adjustable diaphragm pump air regulator assembly having a housing that includes an inlet and an outlet that are configured to be connected to a static air pressure signal. A biasing device is engaged with a valve disposed in the housing and configured to communicate the status air pressure signal to a device outlet that is fluidly separated from the inlet and the outlet associated with the static air pressure signal by the valve. The regulator includes a cam arrangement having a first cam engaged with the biasing device and a second cam engaged with the first cam. The cam arrangement is configured to manipulate a force of the biasing device in response to relative rotation between the first cam and the second cam. A drive sprocket is secured to a shaft connected to the first cam and is constructed to engage a rack secured to a diaphragm pump shaft so that axial translation of the diaphragm pump shaft rotates the first cam relative to the second cam to manipulate the force of the biasing device and thereby the portion of the static air pressure signal that is communicated to the device outlet.

A further aspect of the present invention discloses a method of forming an air pressure regulator assembly. The method includes providing a housing that is constructed to communicate a static air pressure signal to an outlet connected to a diaphragm pump assembly. A shaft of an associated diaphragm pump assembly is mechanically connected to a shaft supported by the housing of the air pressure regulator assembly so that axial translation of the shaft of the diaphragm pump assembly rotates the shaft support by the housing of the air pressure regulator assembly. A cam arrangement is provided that is disposed in the housing and configured to manipulate the portion of the static air pressure signal that is communicated to the outlet connected to the diaphragm pump assembly as a function of a relative position of a diaphragm relative to a range of motion of a diaphragm for each diaphragm stroke.

These and other aspects, objects, features, and advantages of the present invention will become apparent from the following detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
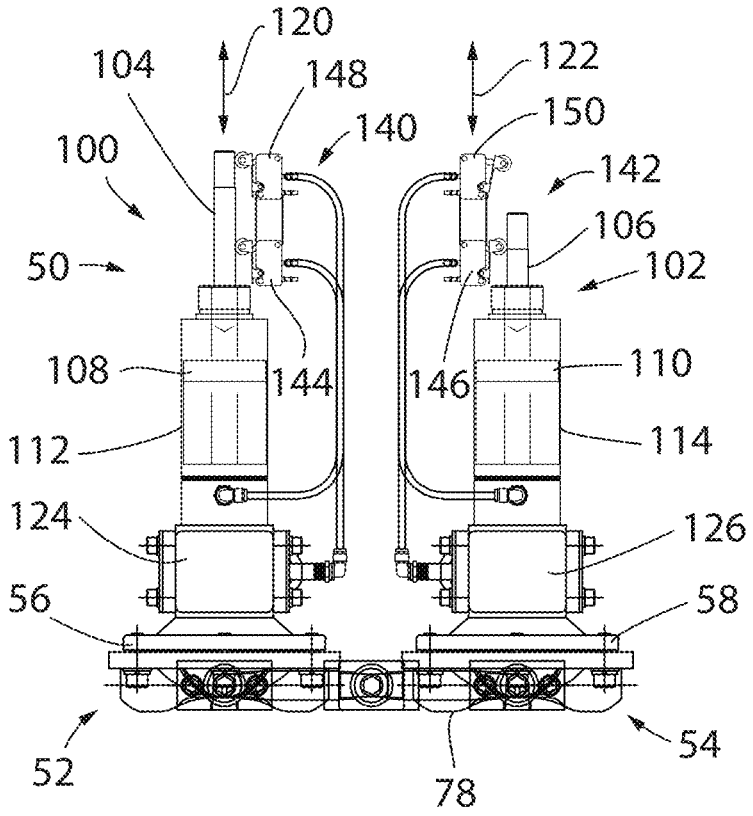
FIG. 1 is a top plan view of a portion of a diaphragm pump system according to one embodiment of the present invention.
Figure 2:
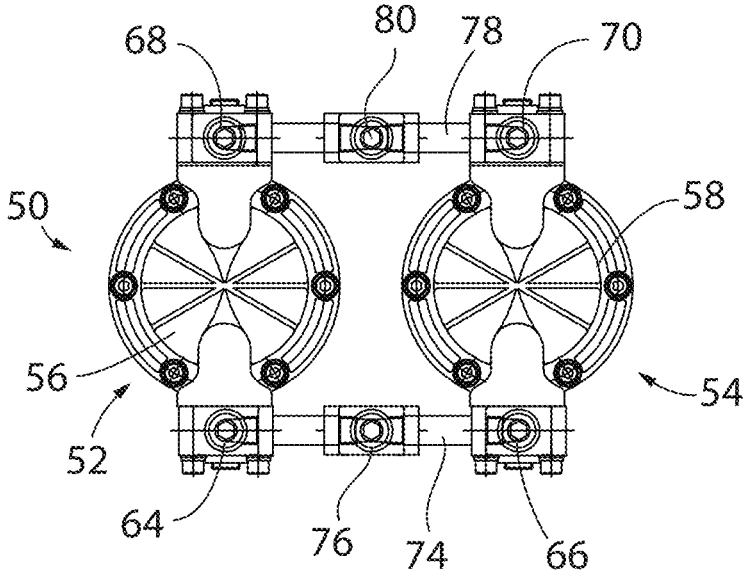
FIG. 2 is a front elevation view of the diaphragm pump system shown in FIG. 1.

Referring to FIGS. 1-2, a diaphragm pump system 50 according to a first embodiment of the present invention includes a first working fluid pumping diaphragm pump assembly 52 and a second working fluid pumping diaphragm pump assembly 54. Each working fluid pumping diaphragm pump assembly includes a respective working fluid pumping diaphragm pump housing 56, 58 that is constructed to enclose a respective working fluid pumping diaphragm as disclosed further below. As is commonly understood, translation of the respective working fluid pumping diaphragms in respective back and forth working directions effectuates the respective intake and discharge strokes associated with communicating a working fluid through the discrete diaphragm pump assemblies 52, 54. As used herein, reference to the respective working fluid diaphragm pump assemblies refers to the portions of system 50 wherein operation of the respective diaphragms associated therewith effectuate translation of the fluid intended to be moved via the cyclic operation of the respective diaphragms associated therewith.

The housing 56, 58 associated with each working fluid pumping diaphragm pump assembly 52, 54 defines a discrete working fluid inlet 64, 66 and a discrete working fluid outlet 68, 70. An inlet manifold 74 fluidly connects the inlets 64, 66 associated with respective diaphragm pump assemblies 52, 54 to a common working fluid inlet 76. Working fluid inlet 76 is constructed to be connected to a bulk fluid source that is intended to be moved by operation of diaphragm pump system 50. A working fluid outlet manifold 78 fluidly connects the respective outlets 68, 70 associated with discrete diaphragm pump assemblies 52, 54 to a common fluid outlet 80. During operation of the respective working fluid diaphragms 60, 62, fluid is drawn from manifold inlet 76 and directed toward the corresponding inlet 64, 66 of a respective working fluid pumping diaphragm pump assembly 52, 54 and associated with a respective intake stroke of a respective working fluid diaphragm. Once drawn into the working fluid chamber associated with each diaphragm pump assembly 52, 54, during a respective discharge stroke of a respective working fluid diaphragm, the working fluid is communicated to a respective outlet 68, 70 and therefrom toward manifold outlet 80. As disclosed further below, diaphragm pump system 50 is configured to provide a substantially uniform pressure and flow signal associated with the working fluid flow even though the resultant working fluid flow associated with discharge manifold 78 is created by combination of the discrete fluid flows associated with operation of respective discrete diaphragm pump assemblies 52, 54.

System 50 includes a first diaphragm retracting assembly or working fluid diaphragm pump operator 100 in the form of a piston assembly 100 and a second diaphragm retracting assembly or working fluid diaphragm pump operator 102 in the form of a second piston assembly 102 which are each discreetly associated with a respective working fluid diaphragm pump assembly 52, 54. Each piston assembly 100, 102 includes a piston shaft 104, 106 that is attached to a respective piston 108, 110 that is slideably disposed within a respective piston shaft 112, 114. Each respective piston 108, 110, and the corresponding piston shaft 104, 106 associated therewith, is slidable in an axial direction, as indicated by arrows 120, 122 to effectuate the discrete cyclic operation of the respective diaphragm 60, 62 of the underlying diaphragm pump assembly 52, 54.

An air manifold 124, 126 is disposed between respective diaphragm assemblies 52, 54 and a corresponding piston assembly 100, 102 and configured to effectuate the desired sequential or controlled operation of discrete diaphragm pump assemblies 52, 54 as described further below. Each piston assembly 100, 102 includes a respective limit control or piston position indication arrangement 140, 142 that cooperates with a respective piston shaft 104, 106. Arrangements 140, 142 provide an indication as to the relative position of the respective pistons 108, 110 and thereby an indication as to the relative position of the respective piston shaft 112, 114, and thereby an indication as to the relative operational position associated with the respective working fluid diaphragm pump assemblies 52, 54. Said in another way, arrangements 140, 142 provide an indication as to the relative intake and/or discharge stroke associated with the respective diaphragms associated with working fluid diaphragm assemblies 52, 54.

Figure 3:
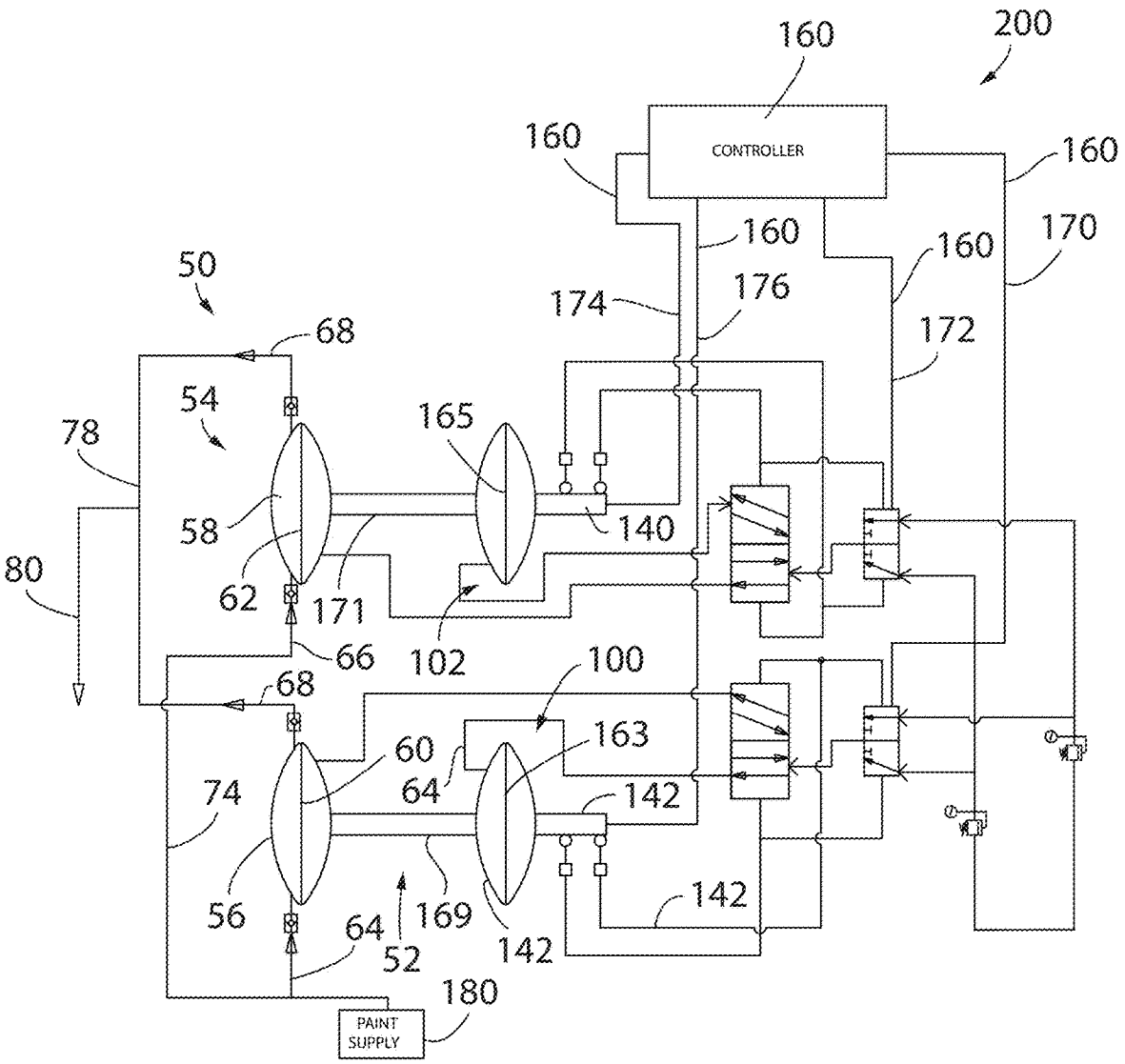
FIG. 3 is a schematic representation of a diaphragm pump system according to another embodiment of the invention.
Figure 4:
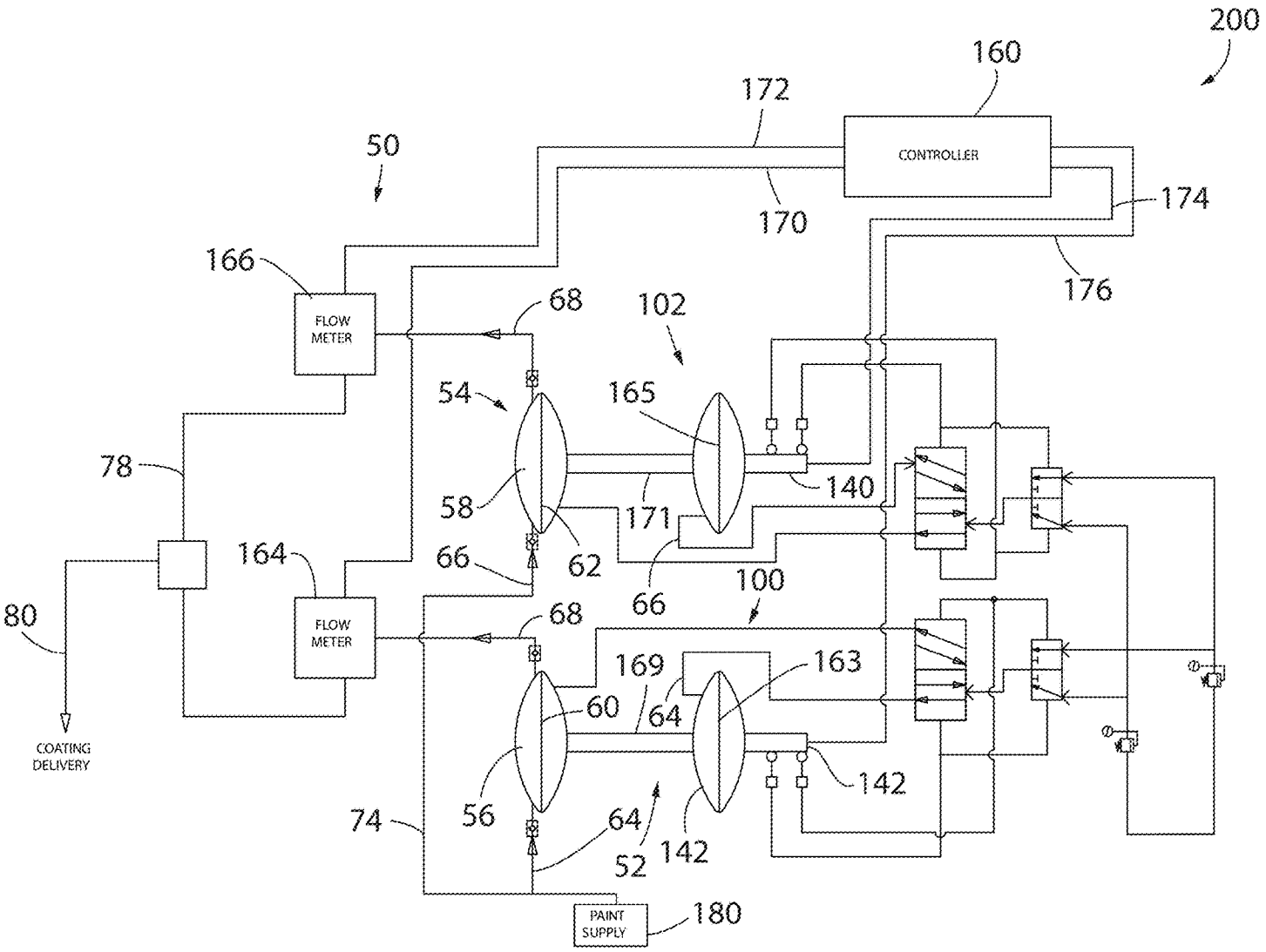
FIG. 4 is a schematic representation of another embodiment of the diaphragm pump system according to another embodiment of the invention.
Figure 5:
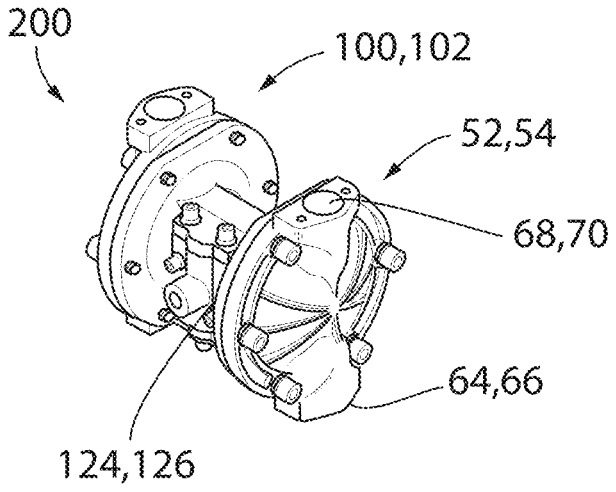
FIG. 5 is a perspective view of one of the working fluid diaphragm pump assemblies and respective working fluid diaphragm retracting assemblies of the diaphragm pump system shown in FIG. 4.
Figure 6:
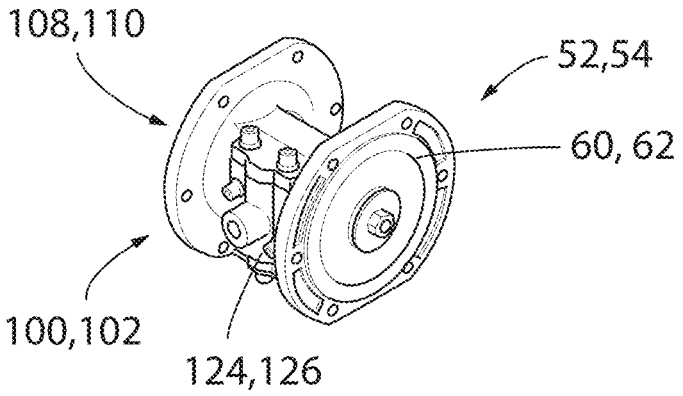
FIG. 6 is a view similar to FIG. 5 and shows a portion of the housing removed from the diaphragm pump system and exposing a diaphragm disposed therein.
Figure 7:
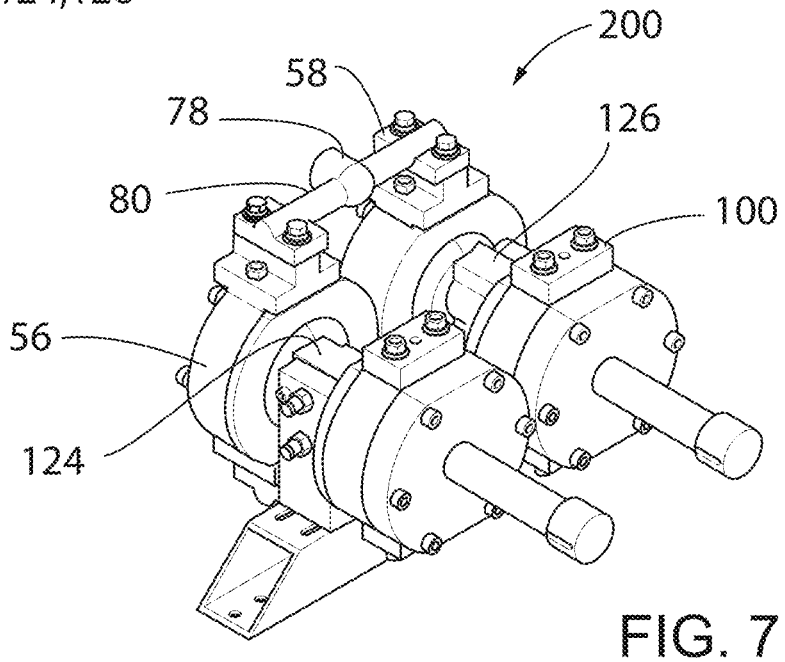
FIG. 7 is a perspective view of the working fluid and retracting diaphragm pump assemblies of the system shown in FIG. 4.

Referring to FIG. 1, in one embodiment, each limit switch assembly or control arrangement 140, 142 includes a first limit switch 144, 146 and a second limit switch 148, 150 that are configured to provide an indication as to the position of piston 108, 110 relative to the respective piston sleeve 112, 114. Such an indication is also indicative of an underlying position associated with operation of respective working fluid diaphragm associated with the respective working fluid diaphragm pump assemblies 52, 54. FIGS. 3 and 4 show a diaphragm pump system 200 according to another embodiment of the present invention. Similar reference numbers are used in FIGS. 1-10 to refer to similar structures between diaphragm pump system 50 and diaphragm pump system 200 and/or interchangeable features therebetween. As set forth further below, it is appreciated that various modalities of a control arrangement are possible and can be desirably configured to achieve the desired operation of a respective diaphragm system 50, 200 in accordance with one or more discrete features disclosed in the present application.

Referring to FIGS. 3-8, diaphragm pump system 200 preferably includes a control, controller, or control arrangement 160 having one or more inputs 162 and is connected to one or more sensors 164, 166 and/or limit switch assemblies or control arrangements 140, 142 associated with assessing the underlying operational condition of the respective working fluid diaphragm pump assemblies 52, 54 and the respective diaphragm retracting assemblies 100, 102 associated with the respective diaphragm pump system 50, 200.

Unlike system 50, diaphragm pump system 200 includes a first diaphragm retracting assembly or working fluid diaphragm pump operator 100 and a second diaphragm retracting assembly or working fluid diaphragm pump operator 102 that are formed as respective non-working fluid diaphragm pump assemblies. Said in another way, a respective diaphragm 163, 165 associated with the pump operators 100, 102 of system 200 are fluidly isolated from the working fluid flow associated with working fluid diaphragm pump assemblies 52, 54 but operationally connected thereto via respective connecting rods 169, 171 such that the cyclic operation of respective diaphragms 163, 165 effectuates the desired cyclic operation of diaphragms 60, 62 but do not directly effectuate movement of the working fluid flow during operation of system 200.

Like system 50, system 200 includes one or more connections 170, 172, 174, 176 that extend between one or more sensors 164, 166 and/or limit switch assemblies 140, 142 so as to provide the desired indication and/or communication of information associated with the desired operation of the underlying respective diaphragm pump system 50, 200. It is further appreciated that, depending on the configuration of the discrete sensors 164, 166 and/or limit switch assemblies and/or control arrangements 140, 142, inputs 170, 172, 174, 176 can be configured to communicate any of an electrical and/or pneumatic operational signals to controller 160 to achieve the desired cyclic operation of respective diaphragm pump assemblies 52, 54 to achieve a generally uniform flow volume and pressure of the working fluid output 80 associated with working fluid flow discharge manifold 78. As disclosed further below with respect to FIGS. 9 and 10, it is further appreciated that the operational functionality associated with the sensors 164, 166 can be provided in various modalities. Although shown as being associated with the working fluid diaphragm retracting assembly, it is further appreciated that the working fluid diaphragm retracting assemblies shown therein could be equivalently be formed as diaphragm retracting assemblies as disclosed above in FIGS. 3-4.

As shown schematically in FIGS. 3 and 4, diaphragm pump working fluid inlets 64, 66 are preferably fluidly connected to one another via intake or inlet manifold 74 which is fluidly connected to a bulk fluid source 180. It is appreciated that source 180 may take many forms such as a bulk container. As disclosed further below, it is envisioned that systems 50, 200 are usable in various environments. For instance, source 180 can be configured as an unpressurized source of bulk material. Although such tanks are commonly referred to in the industry as "pressure pots" wherein the volume of the tank is pressurized to effectuate communication of the bulk materials to the delivery system, there is no need to pressurize the source of bulk material when the same is communicated to an application device via respective systems 50, 200. Such a consideration provides for ready inspection of volume of material that remains available for use and allows for construction of the bulk container system in a lighter form factor in as much as the container is not subjected to pressurization. Systems 50, 200 are configured to be useable in both manual and automatic coating applications including automotive and equipment manufacturing painting operations, application of ultraviolet (UV) coatings such as in the manufacture of wood furniture, cabinets, auto lamp covers, metal furniture, application of ceramic coatings such as in mold making processes common to aerospace applications, application of porcelain coatings such as used in the manufacture and conditioning of bathroom fixtures, as well as the application of chemical agent resistant coatings (CARC) typical to military applications. It should be appreciated that the applications provided above are merely exemplary rather than exhaustive of the uses associated with systems 50, 200.

Regardless of the intended application, operation of respective working fluid diaphragms 60, 62, of systems 50, 200 in response to operation of the respective first and second working fluid diaphragm retracting assemblies 100, 102, whether formed as a piston operational modality, as in system 50, or a diaphragm operational modality, as in system 200, effectuates communication of the working fluid flow from respective inlets 64, 66, to respective discharges 68, 70, and therefrom to the common working fluid flow discharge outlet 80 associated with discharge manifold 78. The sequential operation of working fluid diaphragms 60, 62 associated with generation of the respective discharge strokes is effectuated by operation of respective pistons 108, 110 associated with piston assemblies 102, 104 of system 50 or operation of the respective non-working fluid diaphragms 163, 165 in response to the various pressure and fluid flow signals associated with the controlled operation of the respective diaphragm pump system 50, 200.

Figure 9:
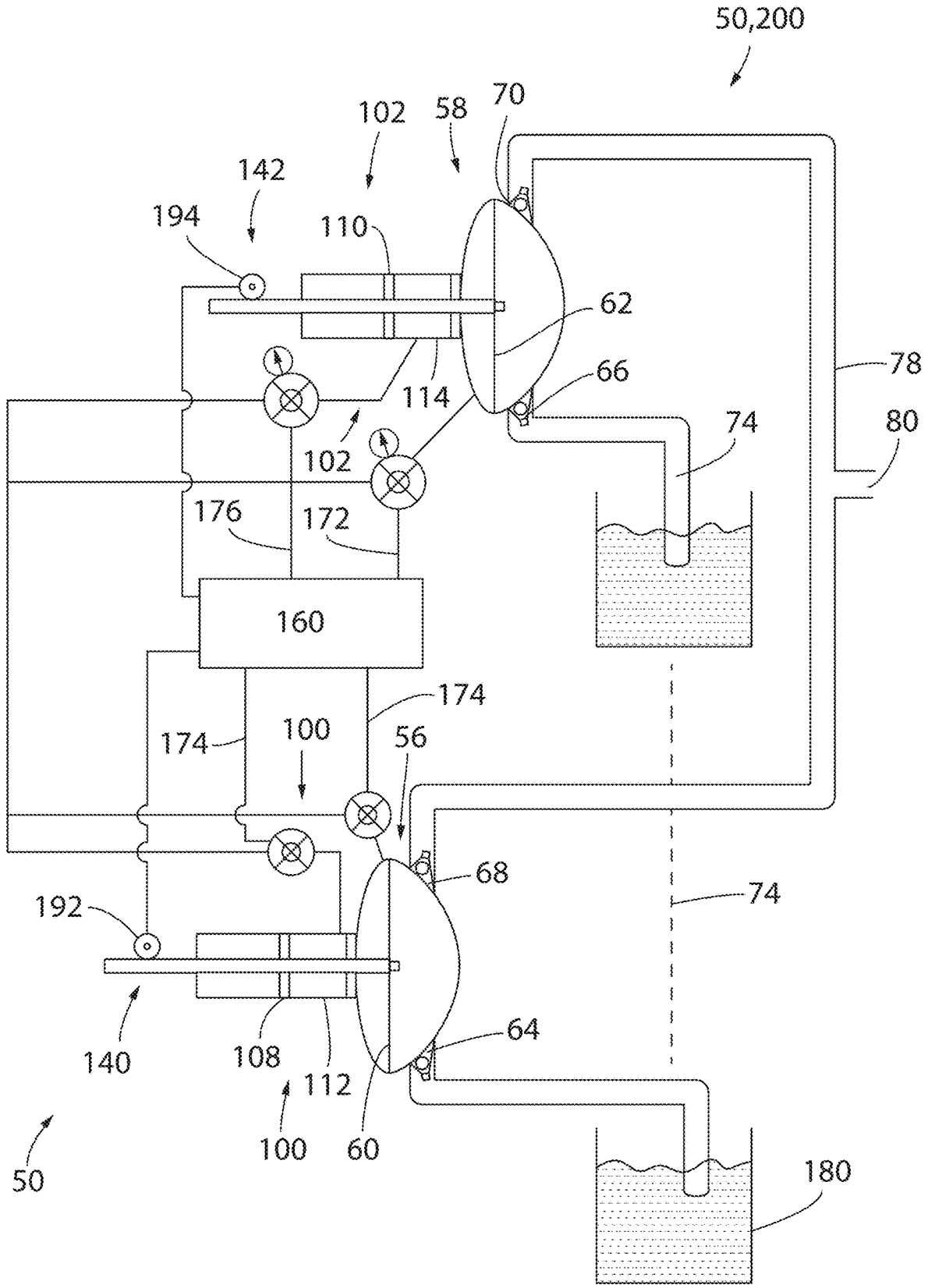
FIG. 9 is a schematic view of the diaphragm pump system shown in FIG. 1 with an alternate diaphragm position detection system according to a further aspect of the present invention.

In an alternate aspect as shown in FIG. 9, limit or position switches 140, 142 associated with the respective position of piston shaft 104, 106 are further provided as a gear limit arrangement 192, 194 associated with providing and/or ascertaining the desired or actual relative axial position of respective pistons 108, 110 relative to respective cylinders 112, 114. Like limit switch assemblies 140, 142, it is further appreciated that gear position indicators 192, 194 be operationally connected to controller 160 so as to provide the desired indication as to the relative position of respective pistons 108, 110 relative to the underlying diaphragm piston pump assemblies 52, 54.

Figure 10:
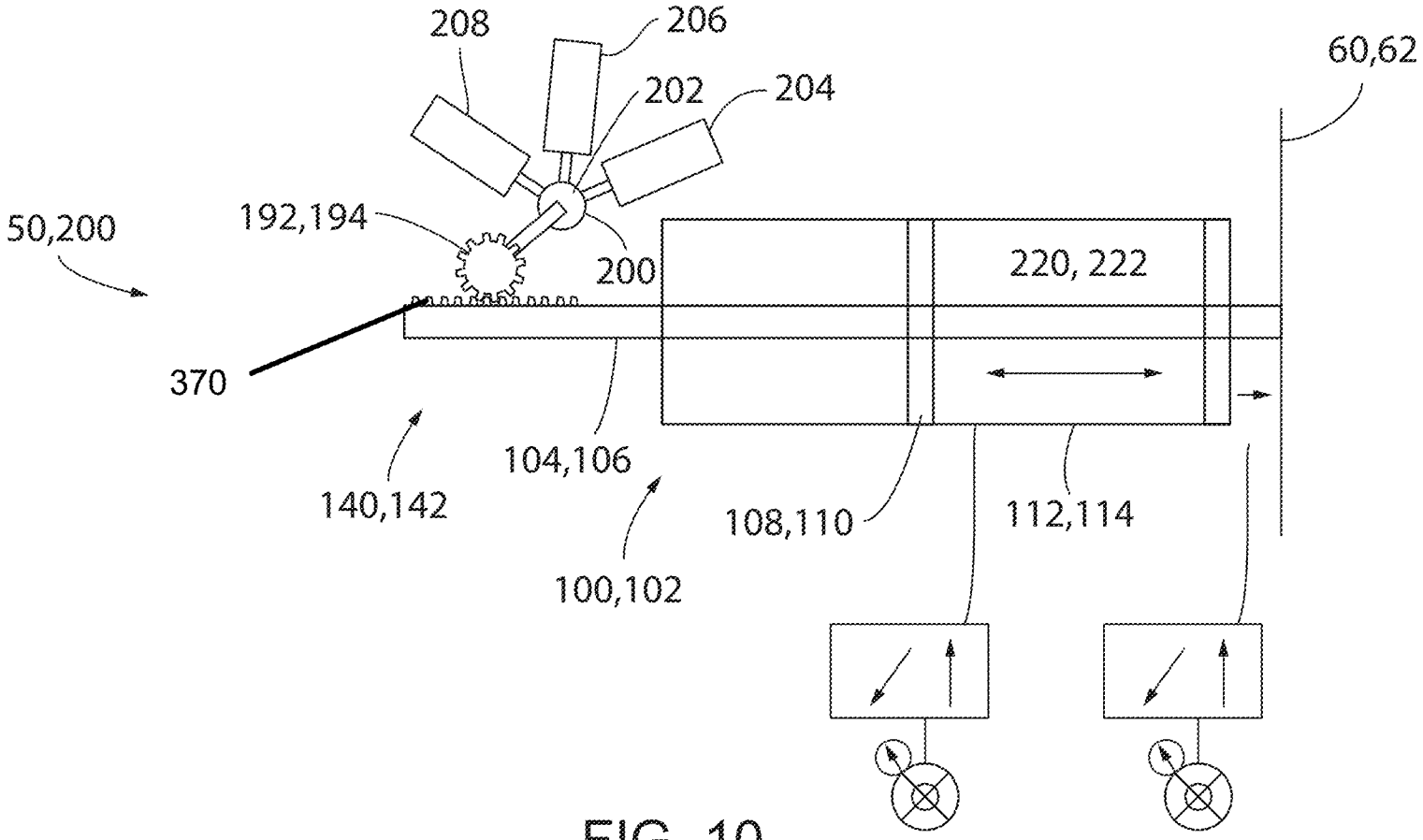
FIG. 10 is a view similar to FIG. 9 and shows another alternate diaphragm position detection system associated to another aspect of the present invention.

Referring to FIG. 10, when provided in a gear driven arrangement, it is further appreciated that respective limit assemblies 140, 142 can include a cam arrangement 201 having one or more lobes 202 that are configured and oriented to interact with one or more axial limit switches 204, 206, 208. The relative position and/or signal associated with switches 204, 206, 208 provides an indication as to the relative orientation of respective piston shaft 104, 106, and the respective piston 108, 110 associated therewith, relative to the corresponding cylinder 112, 114, and thereby a current operating condition associated with a respective working fluid diaphragm 60, 62.

Each of the limit or position indicating configurations disclosed above provides an indication as to the relative orientation associated with a respective diaphragm 60, 62 relative to the respective intake and/or discharge stroke associated therewith. During operation of diaphragm pump systems 50, 200, respective operational instructions are communicated to the chamber associated with a dry, air, or non-working fluid side of respective diaphragm 60, 62 and/or a respective pressure chamber 220, 222 associated with respective piston assemblies 100, 102 so as to effectuate the desired cyclic operation of respective diaphragm 60, 62 at least in part in response to the operating pressure associated with the discharge flow and/or pressure associated with the working fluid flow moved via operation of the respective diaphragm pump system 50, 200.

It is appreciated that the cyclic operation associated with each of discrete pistons 108, 110 or diaphragms 163, 165 associated with the respective working fluid diaphragm retracting assembly can be effectuated with either of a pressure or vacuum signal being communicated to the laterally outboard facing side or the diaphragm facing side associated with each of pistons 108, 110 or non-working fluid diaphragms 163, 165. That is, it is appreciated that a vacuum pressure signal or a position pressure instruction signal can be communicated to a desired respective side of each of respective pistons 108, 110, the non-working fluid side of diaphragm 60, 62, and/or a respective side of non-working fluid diaphragms 163, 165 to achieve the desired intake or discharge stroke of a respective working fluid diaphragm 60, 62.

As disclosed further below with respect to FIG. 11, the respective intake and discharge strokes associated with the operation of diaphragms 60, 62 is effectuated in such a manner so as to generally balance the working fluid pressure and flow characteristics associated with common working fluid output or outlet 80 of discharge manifold 78. The cyclic sequential operation associated with operation of diaphragm assemblies 52, 54 is configured to mitigate pressure and flow spikes associated with respective differentials between the working fluid intake and discharge flows and pressures in response to the sequential operation attributable to the contribution of the discrete diaphragm pump assembly 52, 54 to the resultant overall working fluid flow. That is, diaphragm pump systems 50, 200 are constructed to accommodate and mitigate the fluid flow pressure deviations associated with the cyclic nature innate to the operation of diaphragm pump assemblies 52, 54 wherein each of the discrete diaphragm chambers are associated with translating the working fluid flow through the respective diaphragm pump assembly.

As disclosed further below, the operation of controller 160 that operates to reduce the fluid pressure surges associated with the cyclic operation of diaphragms 60, 62. Referring to FIG. 11, control arrangement 160 is configured to briefly apply a pumping pressure or partial air pressure signal to both of dry side chambers at the same time near the full compression stroke associated with the discharge stroke of each respective diaphragm 60, 62. As disclosed further below with respect to FIG. 11, discrete diaphragm pump assemblies 52, 54, whether the operation is driven by a piston assembly or non-working fluid diaphragm assembly, whose position is monitored via a LVDT sensor or other sensor construction, are constructed to accommodate introduction of an operating air pressure flow, or a portion thereof, concurrently for a brief period, or overlap when one working fluid diaphragm approaches an end of a discharge stroke and the other working fluid diaphragm approaches an end of the intake stroke.

Figure 11:
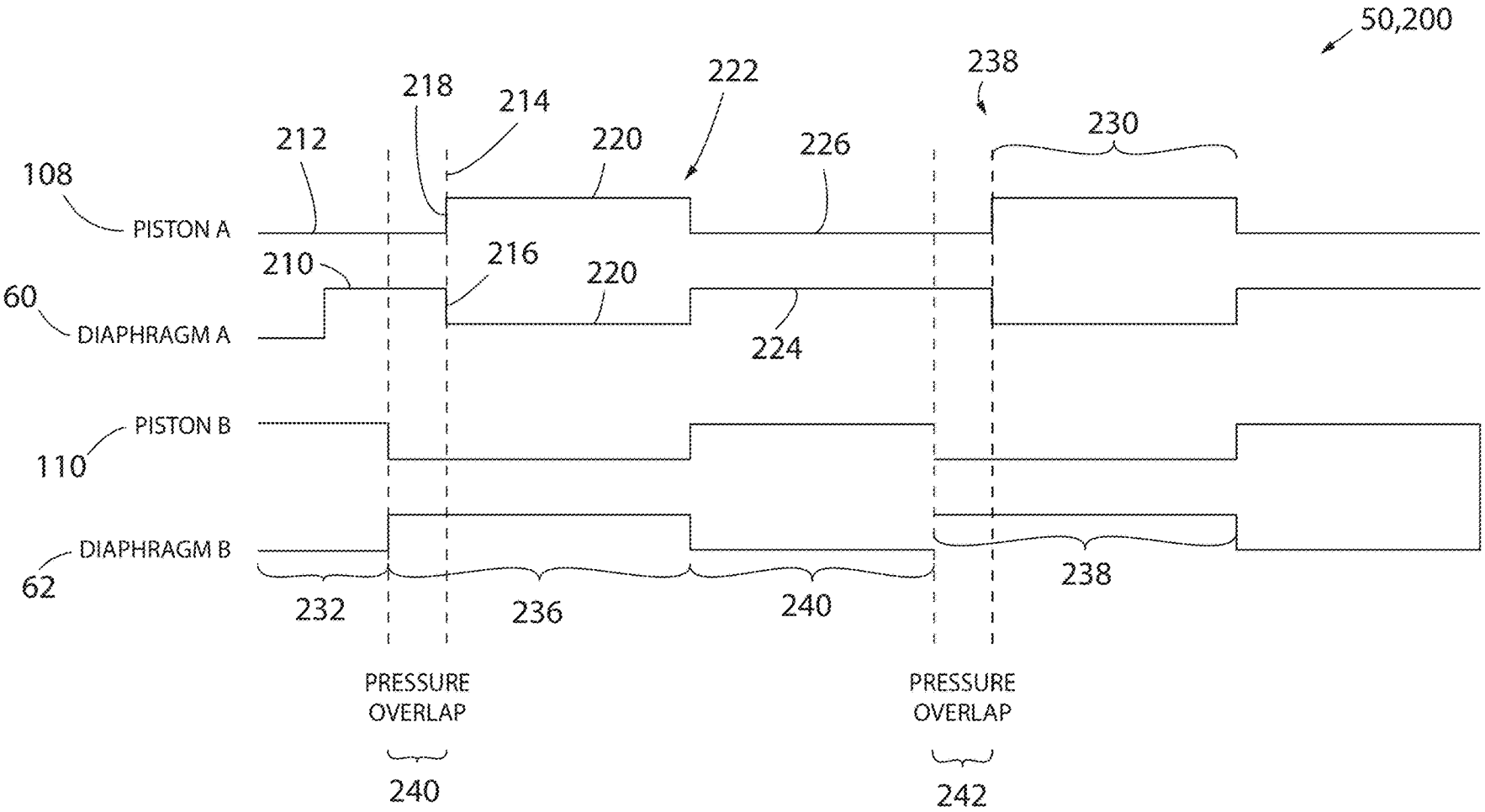
FIG. 11 is a trend plot showing the cyclic operation associated with the first working fluid diaphragm pump assembly and the second working fluid diaphragm pump assembly generated during the operation of the diaphragm pump assemblies show in the Figs. above.
Figure 12:
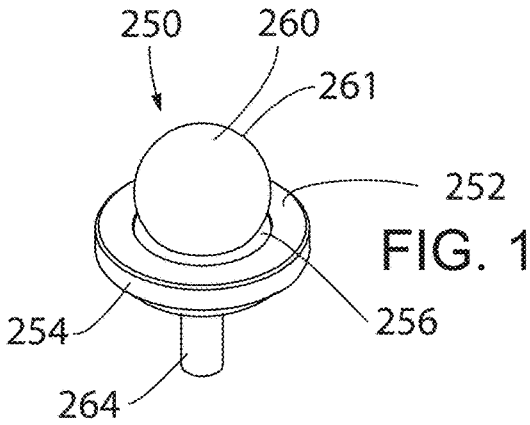
FIG. 12 is a perspective view of a ball valve assembly usable with the diaphragm pump assemblies disclosed above.
Figure 13:
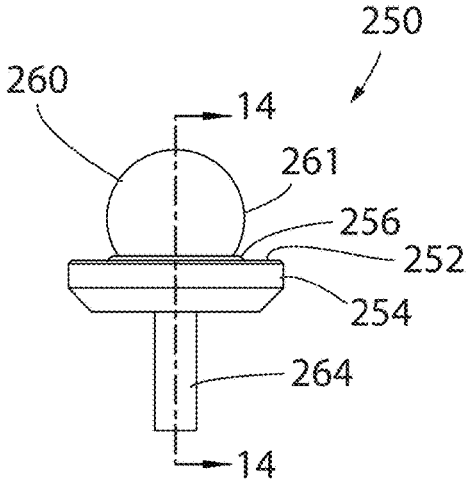
FIG. 13 is a side elevation view of the ball valve assembly shown in FIG. 12.
Figure 14:
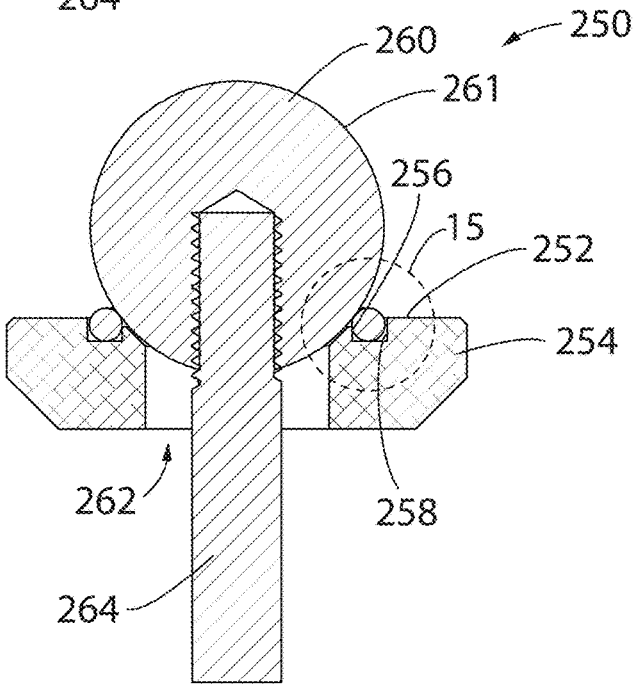
FIG. 14 is an elevational cross section view along line A-A of the ball valve assembly shown in FIG. 13.
Figure 15:
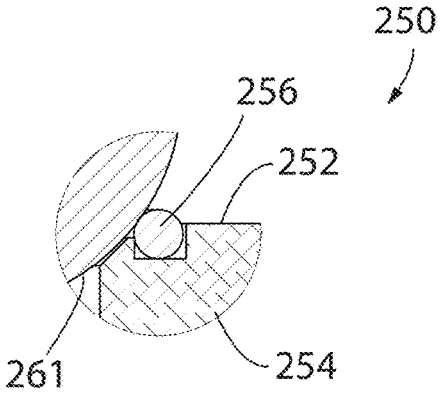
FIG. 15 is a detailed cross section view of the ball valve assembly taken along line B shown in FIG. 14.
Figure 16:
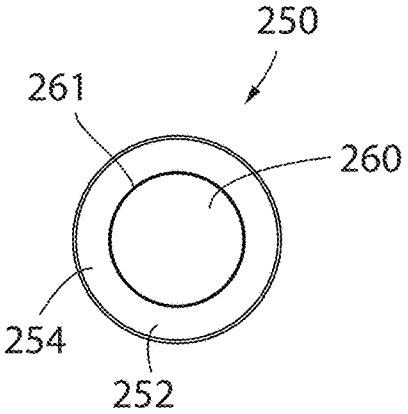
FIG. 16 is a top plan view of the ball valve assembly shown in FIG. 12.

FIG. 11 shows an exemplary operating sequence associated with control of the operation airflow to achieve the desired sequential cyclic operation associated with diaphragm pump system 50, 200. Communication to the air side of diaphragm 60 effectuates a discharge operation associated with diaphragm 60 and translation of piston 108, 212, or a respective non-working fluid diaphragm 163, 165 toward the working fluid side associated with diaphragm 60. Upon completion of the discharge stroke associated with diaphragm 60, 214, communication of the signal associated with nonworking fluid side of diaphragm 60, 216 terminates when an intake instruction 218 is communicated to piston 108 or the respective non-working fluid diaphragm 163, 165 to effectuate an intake stroke 220 associated with diaphragm 60 and piston 108 or a respective non-working fluid diaphragm 163, 165.

Upon completion of the intake stroke 222 associated with operation of non-working fluid diaphragm 165 or piston 108 and diaphragm 60, discharge stroke instructions 224, 226 associated with diaphragm 60 and piston 108, or non-working fluid diaphragm 165, are initiated until initiation 228 of a discharge stroke 230 of diaphragm 60 and associated piston 108 or diaphragm 165. Operation of diaphragm 62 and piston 110, or diaphragm 165, are effectuated in a similar but timewise shifted or offset manner so as to effectuate multiple intake operations 232, 234 and multiple sequential discharge operations 236, 238 associated with operation of diaphragm 62 and piston 110 or diaphragm 163. That is, the discharge strokes associated with operation of diaphragms 60, 62 are timewise offset from one another so as to generate a generally uniform working fluid flow discharge pressure and flow parameters.

Multiple pressure signal overlap areas 240, 242 are provided at the discrete intervals during the cyclic operation of diaphragm 62 and piston 110 or non-working fluid diaphragm 163 and diaphragm 60 and piston 108 or non-working fluid diaphragm 165. Pressure overlaps 240, 242 associated with operation of diaphragms 60, 62 and pistons 108, 110, or non-working fluid diaphragms 163, 165 allows transitioning of each of the respective diaphragms 60, 62 during the respective intake and discharge strokes so as to maintain a generally uniform working fluid discharge flow and pressure associated with the cyclic operation of diaphragm pump system 50, 200 such that system 50, 200 mitigates the flow and pressure spikes associated with the discrete intake and discharge strokes inherent to operation of discrete ones of diaphragms 60, 62 during continued operation of system 50, 200.

Figure 8:
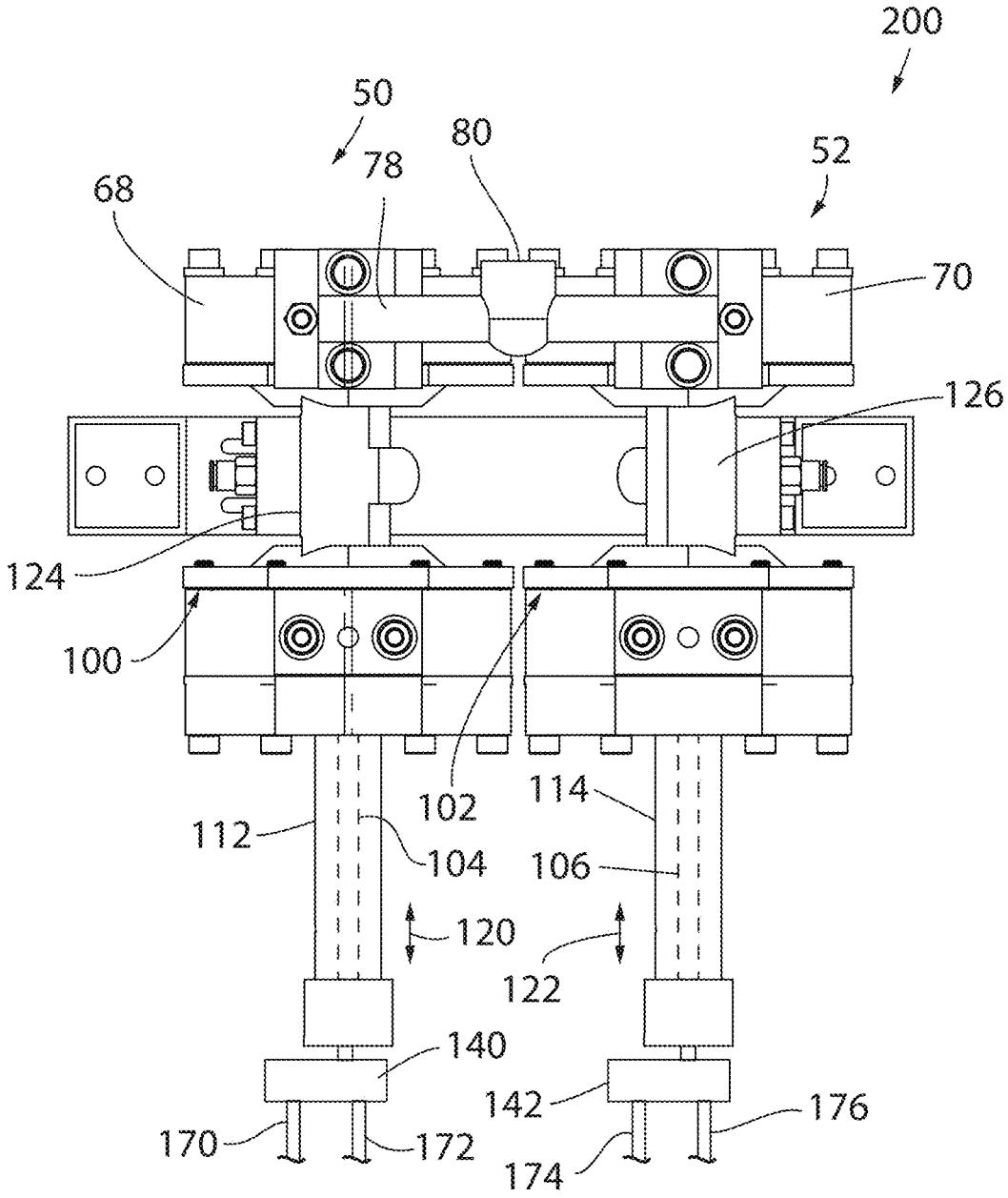
FIG. 8 is a top plan view of the working fluid and retracting diaphragm pump assemblies shown in FIG. 7.

It should be appreciated that although first and second working fluid diaphragm retracting operator or assembly 100, 102 are provided as respective diaphragm assemblies rather than piston assemblies as described above with respect to FIGS. 1-2, the respective diaphragm assemblies associated with the first and second working fluid diaphragm retracting pump operator or assembly 100, 102 as shown in FIGS. 3-8 are fluidly isolated from communication of the working fluid flow through system 200 and are each operable to effectuate manipulation of the respective working fluid diaphragm 60, 62. Referring to FIG. 8, each diaphragm retracting assembly 100, 102 includes a retracting diaphragm shaft 104, 106 that is attached to a respective retracting diaphragm 108, 110 that is slideably disposed within a respective retracting diaphragm shaft 112, 114. Each respective retracting diaphragm 108, 110, and the corresponding retracting diaphragm shaft 104, 106 associated therewith, is slidable in an axial direction, as indicated by arrows 120, 122 to effectuate the discrete cyclic operation of the respective working fluid pumping diaphragm 60, 62 of the underlying working fluid pumping diaphragm pump assembly 52, 54.

An air manifold 124, 126 is disposed between respective working fluid pumping diaphragm assemblies 52, 54 and a corresponding respective retracting diaphragm assembly 100, 102 and configured to effectuate the desired sequential or controlled operation of discrete pumping diaphragm pump assemblies 52, 54 as described above and described further below. Each retracting diaphragm assembly 100, 102 includes a respective limit control or retracting diaphragm position indication arrangement 140, 142 that cooperates with a respective retracting diaphragm shaft 104, 106. Position indication arrangements 140, 142 provide an indication as to the relative position of the respective retracting diaphragms 108, 110 and thereby an indication as to the relative position of the respective retracting diaphragm shaft 112, 114, and thereby an indication as to the relative operational position associated with the respective pumping diaphragm pump assemblies 52, 54. Said in another way, position indication arrangements 140, 142 provide an indication as to the relative intake and/or discharge stroke associated with operation of the respective working fluid pumping diaphragms 60, 62.

Position indication arrangements 140, 142 are constructed to communicate and control operation of working fluid pumping diaphragm pump assemblies 52, 54 and retracting diaphragm assemblies 100, 102 in the same manner as described above with respect to diaphragm pump system 50. As described above, each limit switch assembly or control arrangement 140, 142 includes a first limit switch and a second limit switch that are configured to provide an indication as to the position associated with the respective operation and position of retracting diaphragm 108, 110 relative to a respective retracting diaphragm sleeve 112, 114. Such an indication is also indicative of an underlying position associated with operation of respective working fluid pumping diaphragm 60, 62.

Although not shown in FIGS. 5-8, the diaphragm pump system 200 shown therein includes a control or control arrangement 160 as described above having one or more inputs and is connected to one or more sensors and/or limit switch assemblies or control arrangements 140, 142 associated with assessing the underlying operational condition of the respective working fluid pumping diaphragm pump assemblies 52, 54 and the respective retracting diaphragm assemblies 100, 102. One or more connections 170, 172, 174, 176 extend between one or more sensors and/or limit switch assemblies 140, 142 so as to provide the desired indication and/or communication of information associated with the desired operation of the underlying diaphragm pump system 50. It is further appreciated that, depending on the configuration of the discrete sensors and/or limit switch assemblies and/or control arrangements 140, 142, inputs 170, 172, 174, 176 can be configured to communicate any of an electrical and/or pneumatic operational signals to controller 160 to achieve the desired cyclic operation of respective working fluid pumping diaphragm pump assemblies 52, 54 to achieve a generally uniform flow volume and pressure of the working fluid output 80 associated with working fluid flow discharge manifold 78 in a manner similar to that described above with respect to FIGS. 1-6.

Like the arrangement shown schematically in FIGS. 1-2, the working fluid diaphragm pumps associated with diaphragm pump system 200 shown in FIGS. 3-8 include working fluid inlets that are fluidly connected to one another via an intake manifold which is fluidly connected to a bulk fluid source. Operation of respective working fluid pumping diaphragms 60, 62 in response to operation of respective retracting diaphragm assemblies 100, 102 effectuates communication of the working fluid flow from respective inlets to respective outlets associated with respective working fluid diaphragm pump assemblies 52, 54, and therefrom to the common working fluid flow discharge outlet 80 associated with discharge manifold 78. The sequential operation of working fluid pumping diaphragms associated with generation of the respective discharge strokes is effectuated by operation of respective retracting diaphragms 108, 110 associated with retracting diaphragm assemblies 102, 104 in response to the various pressure and fluid flow signals associated with the controlled operation of diaphragm pump system 50. It is appreciated that operation of the embodiment of the diaphragm pump system shown in FIGS. 3-8 is operable with either of the displacement and control arrangements 140, 142, 160 as described above to achieve the desired cyclic operation of working fluid pumping diaphragm assemblies 52, 54 as shown in FIGS. 3-8 wherein motion of the discrete working fluid diaphragms 60, 62 is provided by operation of the respective retracting diaphragm assemblies 100, 102 and the respective retracting diaphragm shafts 104, 106 associated therewith.

Each of the limit or position indicating configurations disclosed above provides an indication as to the relative orientation associated with a respective working fluid pumping diaphragms 60, 62 relative to the respective intake and/or discharge stroke associated therewith. With respect to the embodiment of diaphragm pump system 200 as shown in FIGS. 3-8, during operation of diaphragm pump assembly 200, respective operational instructions are communicated to the chamber associated with a dry, air, or non-working fluid side of respective working fluid pumping diaphragm 60, 62 and/or a respective pressure chamber 220, 222 associated with respective retracting diaphragm assemblies 100, 102 so as to effectuate the desired cyclic operation of respective working fluid pumping diaphragm 60, 62 at least in part in response to the operating pressure associated with the discharge flow and/or pressure associated with the working fluid flow moved via operation of diaphragm pumping system 200.

It is appreciated that the cyclic operation associated with each of discrete retracting diaphragms 108, 110 can be effectuated with either of a pressure or vacuum signal being communicated to the laterally outboard facing side or the working fluid pumping diaphragm facing side associated with each of retracting diaphragms 108, 110. That is, it is appreciated that a vacuum pressure signal or a position pressure instruction signal can be communicated to a desired side of each of respective retracting diaphragms 108, 110 and/or the non-working fluid side of the working fluid pumping diaphragm 60, 62 to achieve the desired intake or discharge stroke of a respective working fluid pumping diaphragm 60, 62.

As disclosed above with respect to FIG. 10, and with respect to the embodiment of system 200 shown in FIGS. 3-8, it is appreciated that the respective intake and discharge strokes associated with the operation of working fluid pumping diaphragms 60, 62 is effectuated in such a manner so as to generally balance the working fluid pressure and flow characteristics associated with common working fluid output 80 of discharge manifold 78. The cyclic sequential operation associated with operation of diaphragm pump assemblies 50, 52 is configured to mitigate pressure and flow spikes associated with respective differentials between the working fluid intake and discharge flows and pressures in response to the sequential operation attributable to the contribution of the discrete pump assembly 52, 54 to the resultant overall working fluid flow. That is, diaphragm pump systems 50, 200 are each constructed to accommodate and mitigate the fluid flow and fluid flow pressure deviations associated with the cyclic nature innate to the operation of diaphragm pump assemblies 52, 54 as disclosed above.

As alluded to above, the operation of controller 160 associated with the diaphragm pumping system 200 shown in FIGS. 3-8 also operates to reduce the fluid pressure surges associated with the cyclic operation of working fluid flow pumping diaphragms 60, 62. Referring to FIG. 10, control arrangement 160 associated with system 200 shown in FIGS. 3-8 is configured to briefly apply a pumping pressure or partial air pressure signal to both of the respective dry side chambers at the same time near the full compression stroke associated with the discharge stroke of each respective working fluid pumping diaphragm 60, 62. Discrete diaphragm pump assemblies 52, 54 are constructed to accommodate introduction of an operating air pressure flow, or a portion thereof, concurrently for a brief period, or overlap when one working fluid pumping diaphragm approaches an end of a discharge stroke and the other working fluid pumping diaphragm approaches an end of the intake stroke.

FIG. 10 shows an exemplary operating sequence associated with airflow control to achieve the desired sequential cyclic operation associated with working fluid pumping diaphragm pump system 50, 200. Communication to the air side of working fluid pumping diaphragm 60 effectuates a discharge operation associated with working fluid pumping diaphragm 60 and translation of retracting diaphragm 108, 212 toward the working fluid side associated with working fluid pumping diaphragm 60. Upon completion of the discharge stroke associated with working fluid pumping diaphragm 60, 214, communication of the signal associated with nonworking fluid side of working fluid pumping diaphragm 60, 216 terminates when an intake instruction 218 is communicated to retracting diaphragm 108 to effectuate an intake stroke 220 associated with working fluid pumping diaphragm 60 and retracting diaphragm 108.

Upon completion of the intake stroke 222 associated with operation of retracting diaphragm 108 and working fluid pumping diaphragm 60, discharge stroke instructions 224, 226 associated with working fluid pumping diaphragm 60 and retracting diaphragm 108 are initiated until initiation 228 of a discharge stroke 230 of working fluid pumping diaphragm 60 and associated retracting diaphragm 108. Operation of working fluid pumping diaphragm 62 and retracting diaphragm 110 are effectuated in a similar but timewise shifted or offset manner so as to effectuate multiple intake operations 232, 234 and multiple sequential discharge operations 236, 238 associated with operation of working fluid pumping diaphragm 62 and retracting diaphragm 110. That is, the discharge strokes associated with operation of working fluid pumping diaphragms 60 and timewise offset or shift relative to one another so as to generate a generally uniform working fluid flow discharge.

As shown in FIG. 10, multiple pressure signal overlap areas 240, 242 are provided at the discrete intervals during the cyclic operation of working fluid pumping diaphragm 62 and retracting diaphragm 110 and working fluid pumping diaphragm 60 and retracting diaphragm 108, respectively. Pressure overlaps 240, 242 associated with operation of working fluid pumping diaphragms 60, 62 and retracting diaphragms 108, 110 allows transitioning of each of the respective working fluid pumping diaphragms 60, 62 during the respective intake and discharge strokes so as to maintain a generally uniform working fluid discharge flow and flow pressure associated with the cyclic operation of working fluid pumping diaphragm pump system 200 such that system 200 mitigates the flow and pressure spikes associated with the discrete intake and discharge strokes inherent to operation of discrete ones of working fluid pumping diaphragms 60, 62 during continued operation of system 200 and/or for those configurations wherein the working fluid pumping diaphragms are physically connected to one another such that operation of one working fluid pumping diaphragm is physically contingent upon operation of an opposing working fluid pumping diaphragm.

It should further be appreciated that system 200 as disclosed in FIGS. 3-8 can be conveniently provided by manipulation of the construction of what is considered two discrete double working fluid diaphragm pump assemblies. However, as disclosed above, it should be further appreciated that only one discrete side of each double diaphragm pump assembly is associated with the communication of the working fluid flow through system 200. Such considerations present several novel aspects as to the control and operation of the underlying system.

For instance, the retraction speed associated with operation of retracting diaphragm assemblies 100, 102 determines the suction pressure and volume loaded into the working fluid diaphragm pumps 52, 54. In one embodiment, the linear variable differential transformer (LVDT) 140, 142 incorporates a LVDT transducer which provides controller 160 with an analog travel measurement. The measure of travel over time is used by controller 160 to determine speed and flow rate associated with operation of diaphragm pump assemblies 52, 54. Air pressure associated with driving the retraction rate associated with operation of retracting diaphragm assemblies 100, 102 is programmable such that system 200 can be configured to provide a constant retraction rate associated with retracting diaphragm assemblies 100, 102 and thereby working fluid pumping diaphragms 60, 62. Preferably, the speed of retraction associated with operation of the retracting diaphragm assemblies 100, 102 is controlled independently of the speed associated with the working fluid discharge stroke associated with each of the respective working fluid diaphragm pump assemblies. Such a consideration allows control of the retraction or working fluid pump load speed at a constant rate to allow optimization of the discrete working fluid load volumes. Similar considerations provide for control of the working fluid flow rates associated with combined contributions of the discrete working fluid flow diaphragm pump assemblies.

Whether provided as a piston retraction control arrangement or a diaphragm retraction control arrangement, working fluid pumping diaphragms 60, 62 includes some degree of hysteresis associated with the operation of the working fluid pumping diaphragm during each of the working fluid intake and discharge strokes. Accordingly, the pressure required to generate a constant or steady state working fluid flow rate as related to a current stroke condition changes with travel. Controller 160, LVDT 140, 142, and the programmable pneumatic pressure instructions provide a more constant or steady state working fluid delivery rate through adjustment, usually an increase, to the drive pressure as the respective working fluid pumping diaphragm 60, 62 approaches the respective ends of their respective operating strokes.

In a further aspect, systems 200 as disclosed above mitigates instances of reduced working fluid flow rates attributable to inadequate sealing or seating of the check valves associated with the discrete working fluid discharge strokes. During operation with low working fluid output pressures, failure of a discrete check valve associated with respective working fluid flow diaphragm 60, 62 to adequately seal can create a situation wherein a portion of the working fluid discharge flow is contributed to the volume associated and, although the system does not achieve a desired flow rate, the underlying working fluid pumping diaphragm pump assembly continues cyclic operation. Using an activate signal, such as actuation of a spray gun or the like associated with the discharge 80 of manifold 78 allows controller 160 can monitor LVDT's 140, 142 and provide a "check valve leak" signal or automatically reduce a respective pump assemblies 52, 54 compressed air pressure signal until working fluid pumping stops thereby automatically correcting the discharge check valve blow-by or bleed flows.

Accordingly, systems 50, 200, whether configured in accordance with the aspects shown in FIGS. 1-2 or the aspects shown in FIGS. 3-8, provides a diaphragm pump control arrangement having a more universal flow and pressure signal indicia associated with the cyclic operation of the underlying system 50, 200. Whereas pumping diaphragms 60, 62 provide the fluid pressure signal associated with operation of system 50, 200, respective retracting piston and diaphragm retracting diaphragm assemblies 100, 102 provide a pump suction speed associated with determining the pump volumetric output. Discrete pneumatic control of the working fluid pumping diaphragm operating air pressure and retracting piston or diaphragm suction pressure, and the timed pneumatic sequence associated therewith, provides for a selective overlap of the piston and/or diaphragm operating pressure when shifting between the intake and discharge strokes associated with operation of working fluid pumping diaphragm 60 and working fluid pumping diaphragm 62, respectively. The discrete overlap associated with respective pressure signals 240, 242 reduces flow and pressure value pulsatile effects associated with the discharge flow and pressure signal associated with the working fluid flow such that system 50, 200 provides dynamic control of both the suction and pressure speed control associated therewith. Further, each of systems 50, 200 negates the need for refilled and non-recirculated pressure potentiometers as well as fluid flow surge suppressors and/or pressure regulators commonly associated with fluid pump output ports thereby providing a generally robust system having fairly negligible flow surge signals during operation.

FIGS. 12-16 show various views of an optional ball valve assembly 250 usable with at least one, and preferably each, of the respective intake and discharge ports associated with the respective working fluid diaphragm assemblies 52, 54 associated with systems 50, 200. Those skilled in the art will readily appreciate the construction of ball valve assemblies 250 as being commonly disposed between at least one of an inlet passage and a discharge passage between the discrete diaphragm chamber associated with the working fluid and the manifold structure associated therewith. Such ball valve assemblies are commonly configured to prevent flows in the opposite operational flow direction or between discrete inlet and outlet passages during operation of the discrete the diaphragm pump assemblies.

Each ball valve assembly 250 includes a seat 252 that is commonly defined by a portion of the housing 254 or a manifold associated with the discrete working fluid diaphragm pump assembly. Unlike known diaphragm pump assemblies, ball valve assembly 250 includes a seal 256 that is supported by a groove 258 formed in seat 252. Seal 256 is configured to engage an exterior surface 261 of a ball 260 associated with each ball valve assembly 250 when the ball is oriented in a "closed" orientation relative to a respective working fluid flow passage 262 defined by housing 254 or a manifold associated therewith. Ball 260 includes an optional weight 264 that is oriented to gravitationally bias ball 260 into sealed engagement with seal 256.

Whereas rubber ball valves have proved unsatisfactory when systems 50, 200 are used for communicating paint materials to an application device, particularly at the low flow pressure values customary thereto, ball valve assemblies wherein the ball is formed of materials like Teflon and stainless steel are commonly selected but frequently do not seat properly at low pressure differentials between the opposing intake and discharge passages associated with the working fluid diaphragm pump assemblies and tend to result is cross contamination of the fluid flow signals from respective intake and discharge sides of the pump assembly. Such occurrences reduce the ability to accurately control the flow parameters at low flow pressures and volumes as disclosed above. Providing seal 256 and the additional weighting of ball 260 via weight 264 allows the working fluid diaphragm pump assemblies to be constructed in a manner that allows for the placement of a solvent resistant seal 256 in the form of an O-ring to improve the sealing performance associated with operation of ball valve assembly 250 at low working fluid diaphragm chamber conditions prior to development of a desired pressure differential relative to the opposing fluid sides of the ball valve assembly 250 and thereby more accurate control associated with the working fluid flow and working fluid flow pressure associated with operation of systems 50, 200.

FIGS. 17-20 show a mechanically operable air regulator assembly 300 according to another aspect of the present invention. For those diaphragm pump applications wherein electronic control, assessment, and/or operation of diaphragm pump systems 50, 200 may be cost prohibitive or otherwise undesired due to conditions associated with the operating environment, such as wet or excessively dirty environments, mechanically operable air regulator assembly 300 provides a cost effective and robust assembly for manipulating the operating pressure communicated to the discrete working fluid diaphragm pumps associated with systems 50, 200 during desired portions of the respective working fluid discharge diaphragm strokes to maintain a desired more constant pressure and working fluid flow characteristics.

Figure 17:
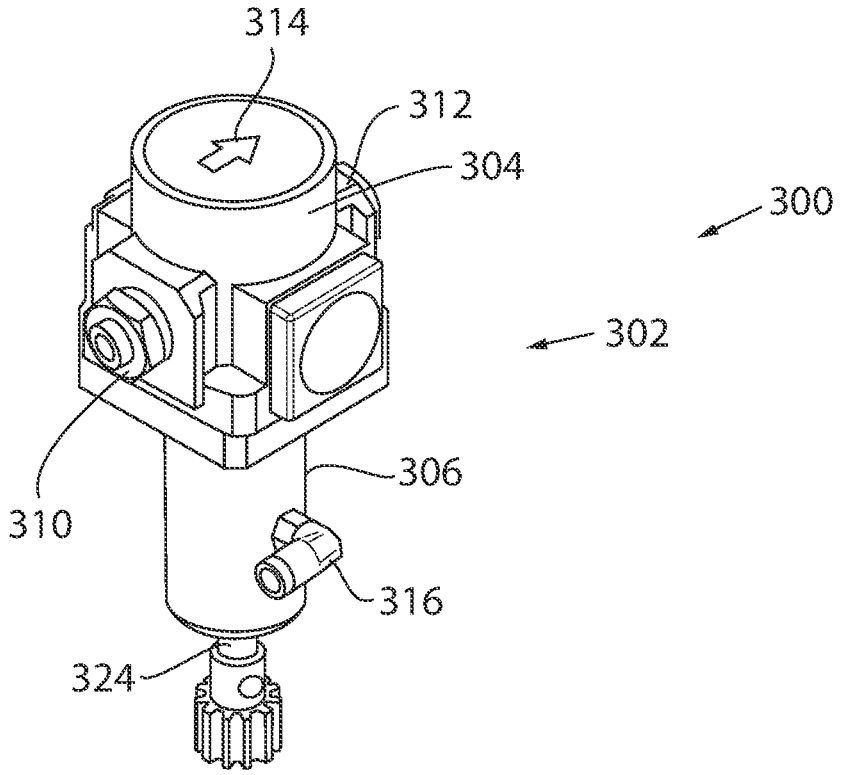
FIGS. 17 and 18 are respective perspective views of a mechanically adjustable air pressure regulator usable with the diaphragm pump systems shown in the proceeding figures.
Figure 18:
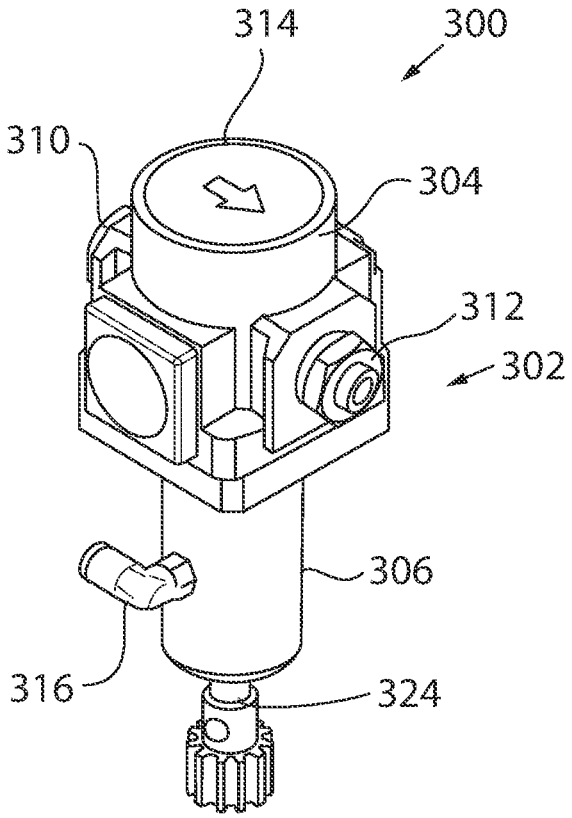
Figure 19:
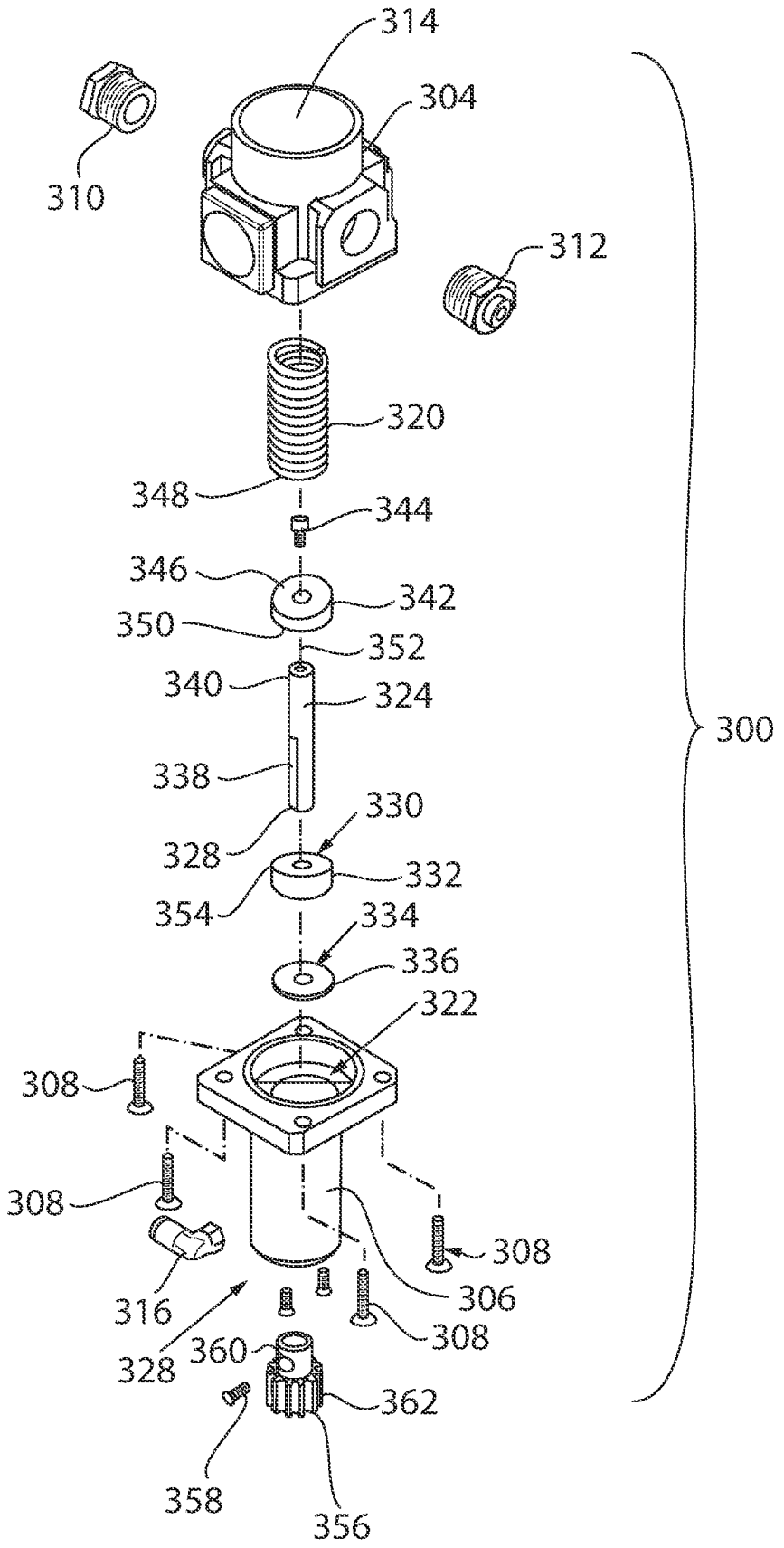
FIG. 19 is an exploded perspective view of the mechanically adjustable air pressure regulator shown in FIGS. 17 and 18.

Referring to FIGS. 17-19, mechanically adjustable regulator assembly 300 includes a housing 302 that includes an upper housing portion 304 and a lower housing portion 306 that are sealingly connected to one another via one or more fasteners 308 (FIG. 19). Upper housing 304 includes an air inlet 310 and an air outlet 312 that are formed therethrough. Preferably, a flow direction indicator 314 is provided of formed on an upper housing 304 and indicates the operating direction associated with passage of operating air therethrough. Air inlet 310 and air outlet 312 are constructed to communicate a static air pump operating pressure through regulator assembly 300 when deployed to control the operating of an underlying diaphragm pump system 50, 200.

A diaphragm or valve (not shown) is disposed in housing 302 and selectively separates the passage between inlet 310 and outlet 312 associated with upper housing 304 and a diaphragm pump working air flow outlet 316 associated with lower housing portion 306. Outlet 316 is constructed to be operationally connected to a respective working fluid diaphragm pump system, such as diaphragm pump systems 50, 200, as described above and communicate a desired variable air pressure signal thereto during the respective working fluid discharge strokes associated with the respective discrete diaphragm working fluid pumps.

Referring to FIG. 19, regulator assembly 300 includes a biasing device, such as a compression spring 320 or the like, that is received in a cavity 322 defined by lower housing portion 306. A shaft 324 is disposed in cavity 322 and constructed to extend beyond an end 326 thereof so as to be mechanically operationally connected to a corresponding diaphragm pump system as disclosed further below. An end 328 of shaft 324 is constructed to pass through an opening 330 defined by a respective cam, or lower cam member 332, and sealingly cooperate with an opening 334 defined by a gasket or seal 336 disposed between lower cam 332 and an interior facing surface of lower housing 306. A land 338 is formed on a lower facing portion of shaft 324 approximate end 328 and is disposed along an exterior surface thereof so as to be exposed beyond housing 302 when regulator assembly 300 is assembled.

An opposing end 340 of shaft 324 is constructed to cooperate with another or an upper cam 342 and is secured thereto via a fastener 344 such that upper cam 342 is rendered none rotatable relative to shaft 324 when secured thereto. Said in another way, shaft 324 is non-rotatable relative to upper cam 342 whereas shaft 324 and upper cam 342 are both rotatable relative to housing 302 and lower cam 332 as disclosed further below.

An upwardly facing surface 346 of upper cam 342 defines a seat 346 that is constructed to engage a lower end 348 of spring 320. The respective upward facing surface of upper cam 342 and the downward facing surface of lower cam 332 are preferably provided in a generally planar construction or constructed to define faces that are oriented to extend in directions that are generally normal relative to an axis of rotation of shaft 324. A downward facing or lower end 350 of upper cam 342 and an upward facing end 354 of lower cam 332 are each pitched relative to a plane normal to the rotational axis, indicated by line 352, of shaft 324. Ends 350, 354 of respective cams 332, 342 are preferably similarly pitched relative to axis 352 and constructed to engage one another when regulator assembly 300 is assembled and manipulate a longitudinal distance between the non-facing ends when cams 332, 342 are rotated relative to one another as disclosed further below.

In a preferred embodiment, respective ends 350, 354 of respective cams 332, 342 are pitched approximately 10 degrees relative to horizontal or a plane normal to the axis of shaft 324. It is appreciated that the relative degree of pitch associated with ends 350, 354 of cams 332, 342 can be provided at other relative values depending upon the intended or desired percentage increase of the input pressure relative to working fluid output pressure communicated with a respective diaphragm pump assembly during the discharge stroke associated with operation of the discrete working fluid discharge. Although the electromechanically controlled collaborative pump arrangements disclosed above accommodate interaction with electronic correction tables associated with determining a percentage increase of input pressure for a desired output pressure throughout the range of operation of the respective working fluid diaphragm, similar performance can be attained by applying the mechanically dual biased air pressure associated with output 316 associated with regulator assembly 300 by the providing of various cam sets having pitch profiles that are tailored to satisfy a desired operating pressure range communicated to the discrete working fluid diaphragm pump assemblies during the discrete working fluid diaphragm pump discharge strokes. Preferably, users can select from various cam profiles so satisfy an expected or desired range of operation.

Regardless of the cam profile selected, a driven element, such as a pinion gear or sprocket 356 is constructed to be secured to a lower end 328 of shaft 324 and located external to housing 302. A securing device, such as a set screw 358 or the like, cooperates with a cavity 360 formed in sprocket 356 and is constructed to engage land 338 defined by shaft 324 when regulator assembly 300 is assembled so as to render sprocket 356, shaft 324, and upper cam 342, non-rotatable relative to one another when regulator assembly 300 is assembled. Sprocket 356 includes a number of teeth 360, preferably 12 teeth at a 20 degree pitch. that are constructed to cooperate with a similarly sized driving element, such as a rack 370 (FIG. 10), when associated with a respective diaphragm pump system 50, 200. Understandably, other relative ranges of operation are envisioned.

Figure 20:
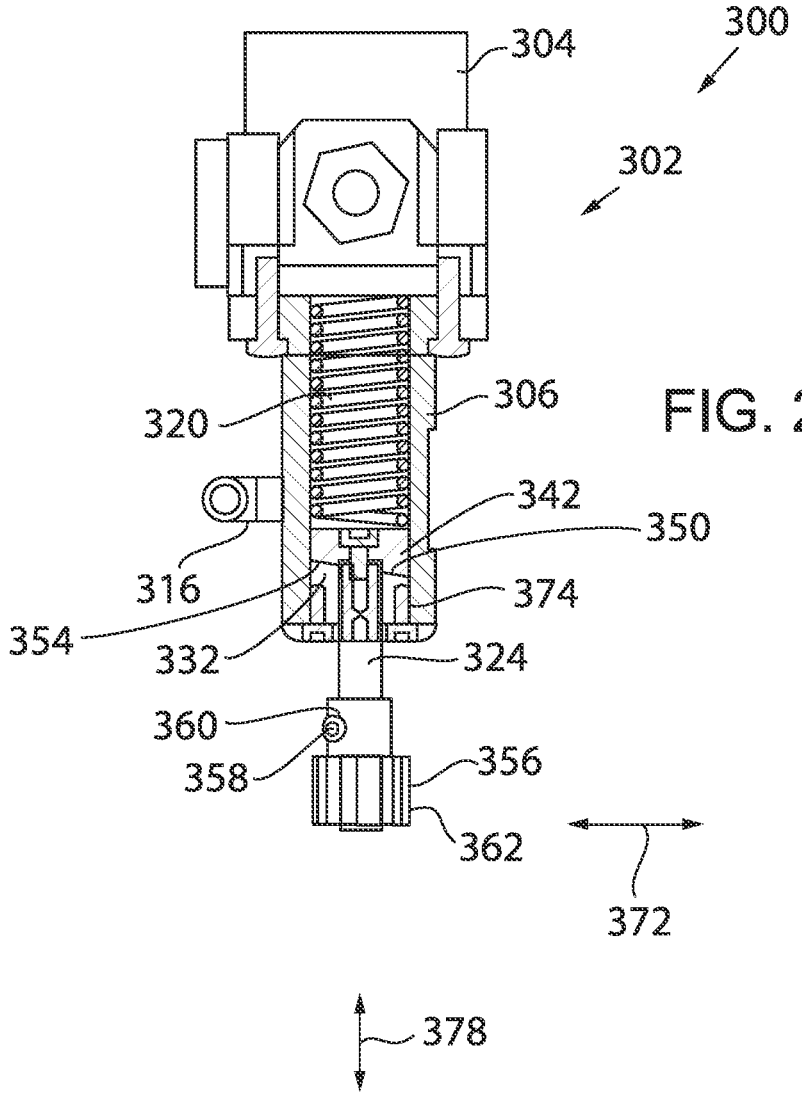
FIG. 20 is a partial cross-section elevation view of the mechanically adjustable air pressure regulator shown in FIGS. 17-19.

Referring to FIGS. 10 and 20, axial translation of rack 370 (FIG. 10), as indicated by arrow 372 (FIG. 20), relative to regulator assembly 300 when engaged with pinion gear 356, effectuates rotation of pinion gear 356, shaft 324 and upper cam 342 relative to regulator housing 302. A number of fasteners 374 secure lower cam 332 relative to lower housing 306 such that lower cam 332, and the relative pitch associated with the upper facing surface thereof, remain positionally fixed relative to upper cam 342 during rotation of gear 356, shaft 324, and upper cam 342. Said in another way, the inclination or pitch associated with upper surface 354 of lower cam 332 is positionally fixed relative to housing 302 whereas downward facing or pitched surface 350 of upper cam 342 is rotated in response to rotation of shaft 324 during rotation of shaft 324 in response to axial translation 372 associated with operation of the discrete working fluid discharge diaphragm pumps during the respective discharge strokes associated with operation of the respective diaphragm pump systems 50, 200.

During the relative rotation between upper cam 342 and lower cam 332, shaft 324, upper cam 342, and pinion gear 356 translate in an axial direction, indicated by arrow 378, along the axis of rotation of shaft 324, relative to housing 302 and thereby manipulate compression associated with operation of spring 320. Manipulating the compression force associated with spring 322 via the relative rotation of cam 342 relative to cam 332 manipulates the output pressure communicated to diaphragm output 316 during the respecting working fluid diaphragm pump assembly discharge stroke. In a preferred embodiment, shaft 324 is constructed to rotate approximately 180° thereby rotating upper cam 342 approximately 180° relative to lower cam 332 such that the respective inclination associated with cam facing surfaces 350, 354 fully contribute to the longitudinal compression of spring 320.

When the inclined faces 350, 354 associated with cams 342, 332 are engaged with one another in a planar manner, a portion of the static air pressure associated with static air pressure inlet 310 and outlet 312 of regulator assembly 300 is communicated to a respective diaphragm pump system 50, 200 as the respective diaphragm pump system 50, 200 progresses toward the top end of the respective discharge stroke. Rotation of upper cam 342 relative to lower cam 332 thereby increasing the force associated with operation of compression spring 320 via the axial translation, or axial separation between upper cam 342 and lower cam 332 and thereby progressively increases and decreases compression force of spring 320, and thereby the static air pressure that is communicated to diaphragm pump output 316, of regulator assembly 300 as the respective working fluid diaphragm progresses toward and regresses away from full retraction of the discharge stroke as a function of the relative angular position of upper cam 342 relative to lower cam 332. Accordingly, regulator assembly 300 is constructed to automatically mechanically manipulate the air pressure communicated to the respective diaphragm pump system 50, 200 during the respective working fluid discharge strokes to provide a uniform working fluid pressure and flow output associated with the operation of each of the discrete working fluid diaphragm systems 50, 200 as a function of the adjustment of the static air pressure communicated to diaphragm pump output pressure associated with output 316. It should be appreciated that output 316 of regulator 300 provides the variable output pressure during each discharge associated with each of the respective working fluid diaphragm pumps associated with the underlying diaphragm pump system 50, 200 but that the air pressure associated with the intake stroke of each diaphragm pump whose operating pressure need not be adjusted during the opposing respective working fluid intake strokes. Although the volume of working fluid loaded during respective intake or suction strokes may vary at different stroke of pump operating speeds, providing adjustable output operating pressure during the discrete working fluid discharge strokes provide intake and discharge strokes that are provided at the same relative respective speeds but in a manner that provides independent intake and discharge stroke operating pressures that accommodate balance and uniformity to the working fluid flow discharge pressure and flow characteristics.

Mechanical manipulation of the air pressure communicated to output 316 as a function of collaborative diaphragm pump operation mitigates drops in the working fluid pressure output as the pump fluid diaphragm moves into the pump cavity as compared to control methodologies wherein the input air pressure is constant and controlled over by operation of characteristics of spring 320. Unlike electronic versions of the collaborative pump operation control arrangement as disclosed above which utilize one or more linear transducers, electronic air pressure regulators, and/or controllers to increase the pump input air pressure as the pump diaphragm moves into the cavity, static pressure air regulator assembly 300 as disclosed above provides the same operation as the systems disclosed above but does so in a manner that is less expensive to implement and which is more robust and easier to service and/or maintain.

During the working fluid output stoke of each respective diaphragm assembly 50, 200, mechanical dual biased operation of air regulator assembly 300 uses a remote manual air pressure regulator to apply a static pressure to the diaphragm or valve of the dual bias regulator assembly 300 and rotational cam 342 and spring 320 act in concert with one another to trim the manual air pressure in accordance to an angular position of the shaft 324 and the rotational cam 342 associated therewith. Although it is anticipated that the rotational cam 342 and corresponding rack 370 can effectuate 180 degrees of relative rotation provides the desired adjustment of the air pressure signal communicated to output 316 it appreciated that other relative ranges of motion can provide similar suitable operation. During operation of a diaphragm pump assembly such as assemblies 50, 200, pressure regulator assembly 300 modifies the pressure stroke drive air pressure based on working fluid diaphragm location to provide a correlation between the concavity of the discrete diaphragm pump housings and the output pressure in relation to the drive air pressure changes with respective to the working fluid chamber diameter to resolve discrepancies associated with the operation of the diaphragm pump associated with the farther the pump diaphragm being pushed into the concave housing to resolve lower working fluid discharge pressures.

Of course, specific details of the preferred embodiment as described herein are not to be interpreted as limiting the scope of the invention, but are provided merely as a basis for the claims and for teaching one skilled in the art to variously practice and construct the present invention in any appropriate manner. Changes may be made in the details of the construction of various components of the discrete pumping diaphragm pump assembly, without departing from the spirit of the invention as defined in the following claims.

What is claimed is:

1. A diaphragm pump regulator assembly comprising:

a housing having an inlet configured to be connected to an air source and an outlet configured to be connected to a diaphragm pump;

a valve disposed in the housing between the inlet and the outlet;

a biasing device disposed in the housing between the valve and the outlet and configured to manipulate a position of the valve relative to the housing;

a first cam and a second cam disposed in the housing and configured to manipulate a force associated with the biasing device;

a shaft secured to the first cam and rotatable relative to the housing; and a driven element secured to the shaft and operable to rotate the shaft and the first cam to manipulate the force associated with the biasing device in response to axial translation of a shaft associated with a diaphragm pump.

2. The diaphragm pump regulator assembly of claim 1 wherein the first cam and the second cam each comprise a pitched surface that faces an opposing surface associated with the other of the first cam and the second cam.

3. The diaphragm pump regulator assembly of claim 2 wherein the first cam and second cam are 180 degrees rotatable relative to one another.

4. The diaphragm pump regulator assembly of claim 2 wherein the pitched surface of each of the first cam and the second cam are pitched at 10 degrees relative to a radial plane that is perpendicular to an axis of the shaft.

5. The diaphragm pump regulator assembly of claim 1 wherein the driven element is further defined as a pinion constructed to engage a rack secured to the shaft associated with the diaphragm pump and is configured to communicate an air flow to the diaphragm pump only during a discharge stroke of the diaphragm pump.

6. The diaphragm pump regulator assembly of claim 1 further comprising another outlet that is fluidly connected to the inlet.

7. The diaphragm pump regulator assembly of claim 1 wherein the second cam is secured to the housing.

8. The diaphragm pump regulator assembly of claim 7 further comprising a gasket disposed between the second cam and the housing.

9. The diaphragm pump regulator assembly of claim 8 wherein the shaft extends through the second cam and the gasket and is rotatable relative thereto.

10. The diaphragm pump regulator assembly of claim 1 wherein the first cam and the driven element are secured to opposite ends of the shaft.

11. A mechanically adjustable diaphragm pump air regulator assembly comprising:

a housing having an inlet and an outlet that are configured to be connected to a static air pressure signal;

a biasing device engaged with a valve disposed in the housing and configured to communicate the static air pressure signal to a device outlet that is fluidly separated from the inlet and the outlet associated with the static air pressure signal by the valve;

a cam arrangement having a first cam engaged with the biasing device and a second cam engaged with the first cam, the cam arrangement being configured to manipulate a force of the biasing device in response to relative rotation between the first cam and the second cam; and a drive sprocket secured to a shaft connected to the first cam and constructed to engage a rack secured to a diaphragm pump shaft so that axial translation of the diaphragm pump shaft rotates the first cam relative to the second cam to manipulate the force of the biasing device and thereby the portion of the static air pressure signal that is communicated to the device outlet during a discharge stroke during operation of a diaphragm pump.

12. The mechanically adjustable diaphragm pump air regulator assembly of claim 11 wherein the first cam and the second cam each include a pitched surface that is pitched relative to a diameter of the respective cam.

13. The mechanically adjustable diaphragm pump air regulator assembly of claim 12 wherein each pitched surface is pitched approximately 10 degrees.

14. The mechanically adjustable diaphragm pump air regulator assembly of claim 13 wherein the pitched surface of the first cam faces the pitched surface of the second cam.

15. The mechanically adjustable diaphragm pump air regulator assembly of claim 11 wherein each of the drive sprocket, shaft, and first cam are movable in an axial direction that is perpendicular to a direction of translation of the diaphragm pump shaft.

16. The mechanically adjustable diaphragm pump air regulator assembly of claim 11 wherein the drive sprocket, shaft, and first cam are slideable along an axis of rotation of the shaft.

17. A method of forming an air pressure regulator assembly, the method comprising:

providing a housing constructed to communicate a static air pressure signal to an outlet connected to a diaphragm pump assembly;

mechanically connecting a shaft associated with the diaphragm pump assembly to a shaft supported by the housing of the air pressure regulator assembly so that axial translation of the shaft of the diaphragm pump assembly rotates the shaft support by the housing of the air pressure regulator assembly; and providing a cam arrangement disposed in the housing and configured to manipulate the portion of the static air pressure signal that is communicated to the outlet connected to the diaphragm pump assembly as a function of a relative position of a diaphragm relative to a range of motion of a diaphragm for each diaphragm discharge stroke, the cam arrangement as a first cam that is positionally fixed relative to the housing and a second cam that rotates to the first cam in response to axial translation of the shaft of the diaphragm pump assembly.

18. The method of claim 17 further comprising forming a rack and pinion engagement between the shaft associated with the diaphragm pump assembly to the shaft supported by the housing of the air pressure regulator assembly.

19. The method of claim 17 further comprising adjusting a force of a biasing device disposed within the housing in response to a relative rotational orientation of the cam arrangement.

* * * * *